US011712714B1

(12) United States Patent
Bilge et al.

(10) Patent No.: US 11,712,714 B1
(45) Date of Patent: Aug. 1, 2023

(54) ADAPTOR FOR INCREASING EFFICIENCY OF A CAULKING PROCEDURE

(71) Applicants: Henry H. Bilge, Fort Lee, NJ (US); Tolga M. Bilge, Fort Lee, NJ (US)

(72) Inventors: Henry H. Bilge, Fort Lee, NJ (US); Tolga M. Bilge, Fort Lee, NJ (US)

( * ) Notice: Subject to any disclaimer, the term of this patent is extended or adjusted under 35 U.S.C. 154(b) by 0 days.

(21) Appl. No.: 17/143,157

(22) Filed: Jan. 7, 2021

(51) Int. Cl.
*B05D 1/32* (2006.01)
*B05D 1/26* (2006.01)
*B44C 7/06* (2006.01)
*B05C 17/005* (2006.01)

(52) U.S. Cl.
CPC ..... *B05D 1/325* (2013.01); *B05C 17/00589* (2013.01); *B05D 1/265* (2013.01); *B44C 7/06* (2013.01)

(58) Field of Classification Search
CPC ..... B05C 17/0052; B05C 17/00589; B05C 17/10; B05C 21/005; B05D 1/322; B05D 1/325; B05D 1/40; B05D 1/42; B05D 1/265; B44C 7/06; E04G 21/201; E04F 21/165; E04F 21/1652; E04F 21/1655; E04F 21/1657; E04F 21/161; E04F 21/162; E04F 21/163
See application file for complete search history.

(56) References Cited

U.S. PATENT DOCUMENTS 1,085,566 A * 1/1914 Glover ..... B05B 11/3074 235/94 R
3,260,638 A * 7/1966 Hoveland ..... E04F 21/165 156/461
4,358,337 A * 11/1982 Johnson ..... E04F 21/026 156/577
4,555,298 A * 11/1985 Boucher ..... B44C 7/06 156/577
4,652,331 A * 3/1987 Plasencia ..... E04F 21/1655 156/577
5,017,113 A * 5/1991 Heaton ..... B05C 17/00596 222/327
5,622,728 A * 4/1997 Kartler ..... E04F 21/1655 425/458
5,660,678 A * 8/1997 Parker, Jr. ..... B65H 35/02 156/577
5,792,489 A * 8/1998 Liberman ..... E04F 21/1655 425/458
5,814,184 A * 9/1998 Denkins ..... B65H 35/0086 156/577
7,281,875 B1 * 10/2007 Todd ..... B05C 17/02 401/219
2020/0130980 A1 * 4/2020 Wold ..... E04F 21/1655

FOREIGN PATENT DOCUMENTS

CN 108385953 A * 8/2018 ..... E04F 21/165
DE 102014115466 A1 * 4/2016 ..... B05C 17/005
WO WO-2007039247 A1 * 4/2007 ..... E04F 21/1652

* cited by examiner

*Primary Examiner* — Donnell A Long
(74) *Attorney, Agent, or Firm* — Joshua Kaplan, Esq; Kaplan Law Practice LLC

(57) ABSTRACT

The disclosed device is an adapter to an existing caulking methodology. The adapter is configured to perform the activity of protective taping, scraping and cleaning of excess compound to occur simultaneously with caulking. The disclosed adapter removably attaches to cannister holding cradle of a calking gun. At least one front roller presses a strip of tape against a side of an area being caulked or finished, with tape being drawn from a tape roller in back of the front roller.

10 Claims, 23 Drawing Sheets

Fig. 4A
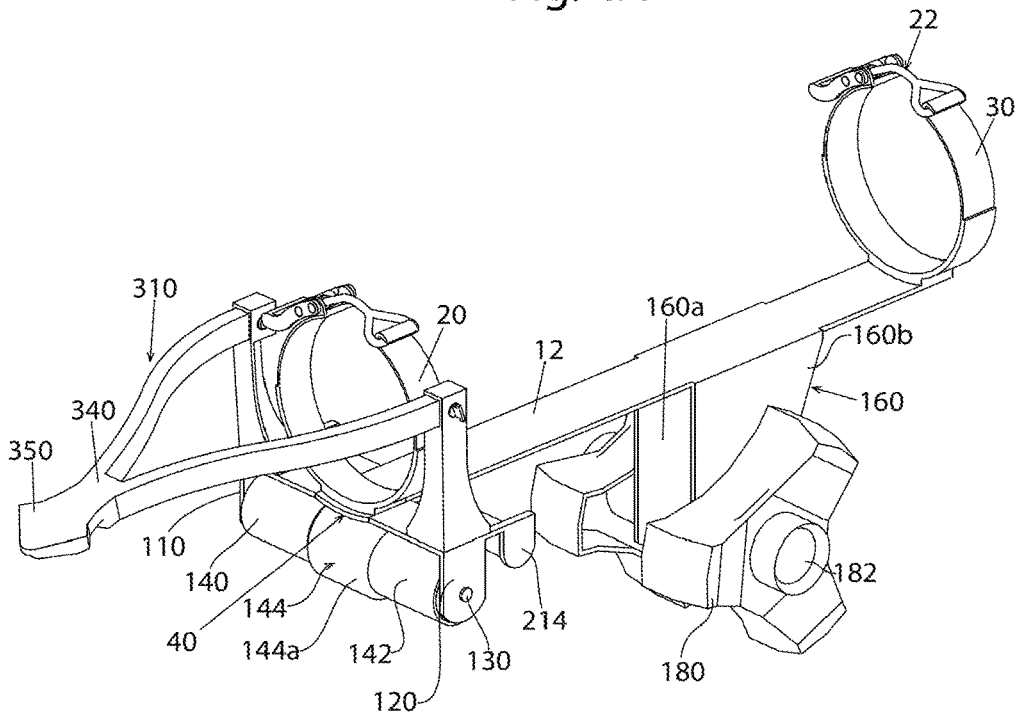
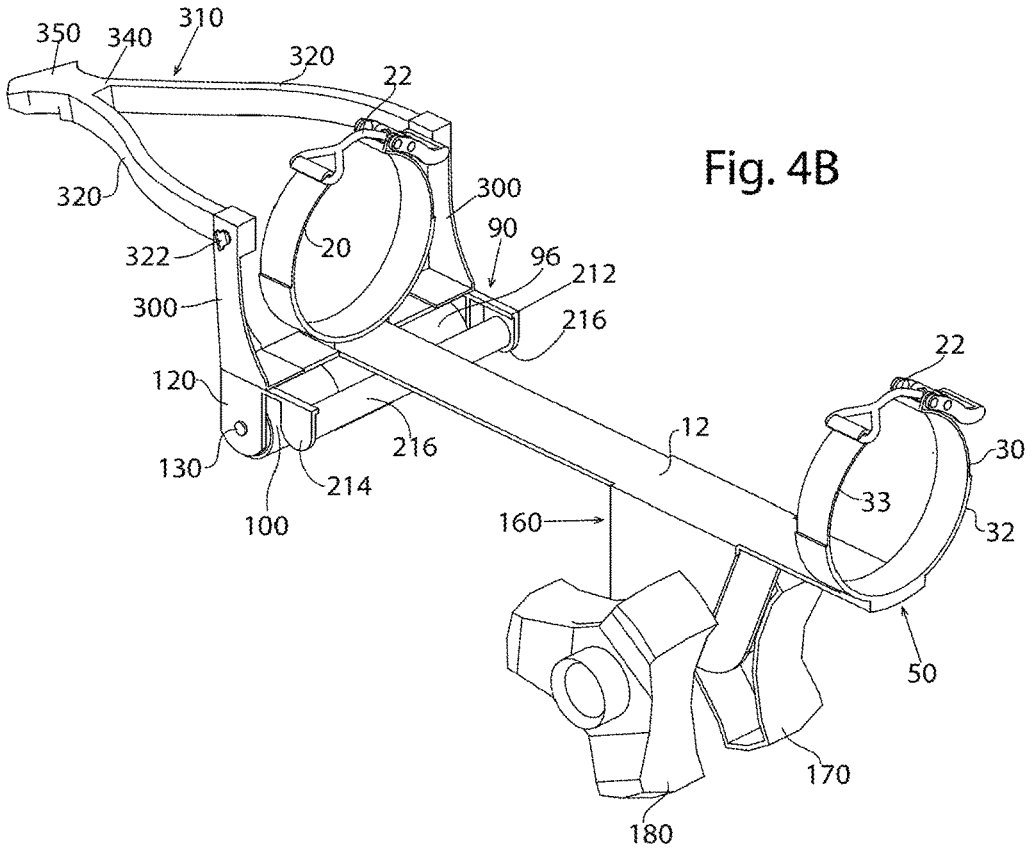
Fig. 4B

ADAPTOR FOR INCREASING EFFICIENCY OF A CAULKING PROCEDURE

FIELD OF THE INVENTION

The present invention relates to adapters to existing tools designed to improve effectiveness, efficiency and user experience of existing wall finishing tools.

BACKGROUND OF THE INVENTION

Caulking is a process of applying a compound for ascetic or moisture sealant purposes. Caulking is done by extruding a bead of caulking compound from a tube or canister into a seam or joint. The procedure is then followed by leveling the spreading or brushing or scraping away of excess compound.

Presently, the caulking process is a three-step procedure. The first step is preparation of surfaces, which primarily is focused on placing protective masking or painter's tape on areas adjacent to the seam. After the taping is completed, actual caulking commences. After caulking, one uses a scraping tool, usually a spade trowel, to compact the compound into the seam and simultaneously scrape away excess material. There is also the fourth step of removing the protective tape and performance of other cleanup tasks.

The steps of taping, caulking and scraping are time consuming and labor intensive. Each process requires that a laborer performing the task, perform work on the same area at least three times, Furthermore, since placing of the tape on the seam is a separate process, a laborer tends to use more tape than necessary to achieve the desired result. Therefore, combining the first three steps of taping, caulking and scraping into one step greatly improves efficiency and reduces labor requirements and the tedium of the task.

SUMMARY OF THE INVENTION

It is an object of the present invention to reduce time spent on caulking projects.

It is another object of the disclosed apparatus to combine the steps of taping, caulking and scraping into one step.

It is another object of the disclosed invention to combine tools required in initiating and completing the caulking operation into a single apparatus.

The present disclosure describes an adapter apparatus that is intended to be used in combination with caulking cradle containing a caulking cannister. It is understood that the disclosed adapter can be used with a device having a similar use and purpose as a caulking frame.

The application discloses a base wall having a first end and a second end. A first attachment means, and a second attachment means are attached to the base wall. The first attachment means secured to the base wall near the first end. and the second attachment means secured at the second end of the base wall. The first and said second attachment means are intended to secure the base wall to a canister cradle of a caulking gun.

Further disclosed is an angle bracket the angle bracket attaching to the base wall at the first end. The angle bracket having a first wall. The first wall is attached to the base wall in a perpendicular orientation or direction with respect to the base wall. The overall angle bracket comprising of a first wall having a second wall and a third wall. The second and third walls extending downwardly from the first wall, in a parallel, spaced apart relation to each other.

In one embodiment of the disclosed apparatus, the second wall and a third wall contain openings that are co-axial. The openings supporting a first pivot mounted within the first openings. The first pivot rotatingly supporting a first roller.

The base wall further discloses a rear angle bracket. The rear angle bracket mounting along the length of the base wall. The rear angle bracket extending downward from the base wall and comprising a rear pivot that is at a right angle to the axis of the base wall. The orientation of the rear pivot is also parallel with the first pivot. The rear pivot rotatingly supporint a first back roller. When the first roller and the first back roller are lined up one behind the other, such as when looking directly at the front of the disclosed adapter, the first roller and the first rear roller are linearly one behind the other.

The back roller is intended to support a reel of tape. A user of the apparatus would then take a free end of this tape and extend it towards the first roller. The strip of tape so extended is then passed between the first roller and the work surface.

It is preferred that the disclosed adapter contain a supplemental pivot mounting between second and third walls behind the first pivot. The supplemental pivot is in a parallel and spaced apart configuration with the first pivot. The supplemental pivot may contain one wide or several narrower rollers. The purpose of the supplemental roller(s) is to guide the section of the tape being unraveled from the first rear roller over the supplemental roller, such that the free end of the unraveled tape will pass between the first roller and the work surface.

In a further embodiment, it is preferred that the disclosed adapter contain a second roller and a second rear roller. The second roller is mounted on the first pivot, adjacently, but in spaced apart configuration with the first roller. The second rear pivot is mounted on the rear pivot of the rear bracket in a parallel configuration with the first rear roller. The second roller and the second rear roller are positioned in the same linear orientation with one another.

The second roller is intended to support a reel of tape in addition to or instead of the tape being supported on the first rear roller. A free end of the tape on this tape roller is unraveled and passed over the one or more supplemental roller and then beneath the second roller, such that the tape is pressed by the second roller against the work surface.

In one embodiment of the disclosed adapter the space between the first and second roller is regulated using at least one third roller, which is mounted between the first and second rollers. Additional third rollers, or alternatively, fewer third rollers may be used to regulate the space between the first and second rollers. It is preferred that the third roller is of greater diameter than the first and second roller. The third roller is then placed into the groove being worked on by the disclosed device, and functions as a guide to ensure that the adapter remains directly over the seam being caulked as a user drags the disclosed adapter and the calking gun over the work surface.

Further disclosed with the present adapter and across all embodiments disclosed below is a scraping tool that is used to direct the caulking compound into the same and, to also clear away access caulking compound. The scraping tool is shown to be in the form of a spade, but other scraping tool variations may be easily adopted for use with the disclosed apparatus. The scraping tool is mounted to the angle bracket using forked support arms that are inserted onto slots on parallel supports. The parallel supports are mounted on the top surface of the first wall of the angle bracket.

In some embodiments the height and degree of extension of the scraping tool with respect to the front, of the adapter can be controlled using pinned slots that exist along the height of the parallel upright supports, to control elevation, and using pinned slots of the forked support arms, to control extension. The scraping tool is intended to be situated just ahead of an extruding nozzle, such that the compound being extruded by the nozzle, is then immediately leveled and trimmed by the scraping tool.

In another embodiment the first pivot does not directly rotatingly mount either the, first or the second rollers mounted thereon. Instead, the first and second rollers are mounted onto the first or second roller cradles, respectively. The first roller cradle is comprised of a first adjustment wheel is threadingly mounted onto the first pivot. A non-rotating sleeve is attached obliquely to the first adjustment wheel, the sleeve being in a parallel spaced apart configuration with the first pivot. The first roller is then rotatingly mounted and removable mounted onto the sleeve.

Similarly, the second, roller cradle is formed using a second adjustment wheel which is thredenegly mounted on the first pivot in an adjacent, spaced apart orientation to the first adjustment wheel. A sleeve extending from the second adjustment wheel in a direction opposite from the sleeve extending from the first adjustment wheel. The sleeve attaching to the second adjustment wheel being in a parallel, spaced apart and non-rotating relation to the first pivot. A second roller then rotatingly mounted onto the sleeve of the second cradle.

The space between first and second rollers in the first alternative embodiment being controlled by rotating the first and second adjustment wheels, thus spreading apart or drawing closer the gap between the first and second roller cradles along the length of the first pivot.

It is preferred that the tread of the first and second adjustment wheels extends beyond the surface of the first or second roller so as to dip into the seam being caulked and prevent the adapter slipping off of the seam. It is another preference of this embodiment to have a terminal wheel at the free end of the sleeves issuing obliquely from the first and second adjustment wheels. The terminal wheel is attached to the sleeve and thus rotates together with the shaft as the adjustment wheel to which the shaft is attached is rotated to change the position of the first or second cradle along the length of the first pivot Plates protruding from between the first and second roller and between the first and second adjustment wheel, respectively, may extend into the seam being worked on, so as to function as guide measure to keep the disclosed adapter centered above the seam.

In the first two embodiments disclosed above, the first pivot is mounted through circular first openings by having the first openings being threaded, or by using lug or wing nuts to secure a section of the first pivot protruding through the first openings.

In another embodiment the first pivot is replaced by an assembled pivot dedicated to an individual first or second roller. In this embodiment, the first opening is shaped as a socket, such as a square or hexagonal socket. A first fastener having a head portion fitting within the socket of the first opening. Head being substantially flat or cup like. A threaded portion of the first fastener then extending into the angled bracket and threadengly jointed with a first horizontal sleeve. The first horizontal sleeve is terminated by a first horizontal flange.

Similarly, a second roller is rotatingly mounted over a second horizontal sleeve. The second horizontal sleeve is held in place by a second fastener, where the head of the second fastener is locked in the socket first opening of the third wall. The second vertical flange terminating the second horizontal sleeve. The central gap between the first and second rollers is then maintained by first and second vertical flanges Thus rotating the flange causes the horizontal sleeve to travel along the length the first or second hosteller, causing the distance between the first or second rollers to grow or decrease.

Two additional embodiments are possible. In one embodiment the upright supports and the forwardly extending scraping tool is not disclosed. Disclosed are only the first or second rollers, together with first or second rear rollers, with a supplemental roller being closely associated behind the first or second rollers.

In another embodiment, two parallel upright supports are used to mount support arms of a scraping tool. The support arms come together at a point just ahead of a nozzle of a cannister being retained with the caulking gun. Extending beyond this point is the scraping tool. In this embodiment, taping is either not needed or is performed as a separate step.

BRIEF DESCRIPTION OF THE DRAWINGS

FIGS. 4A and 4B are perspective views of the disclosed adapter apparatus.

DESCRIPTION OF THE PREFERRED EMBODIMENTS

Figure 1:
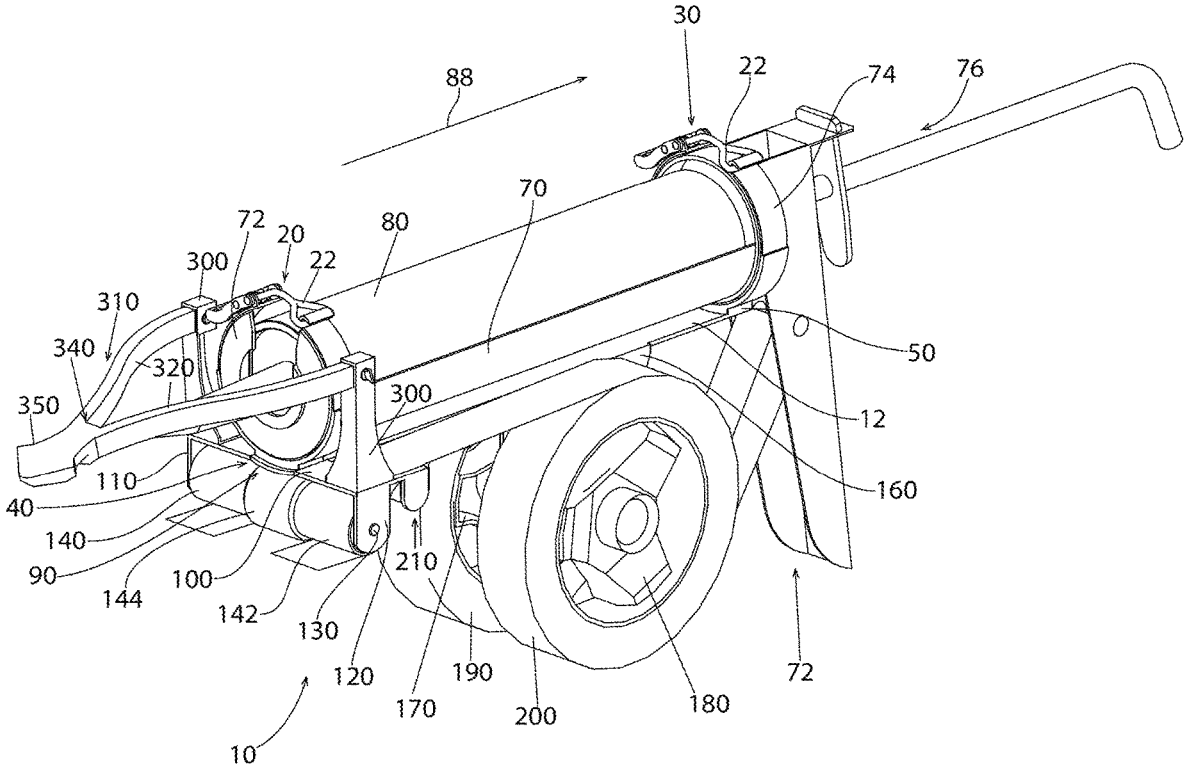
FIG. 1 is a perspective view of one embodiment the disclosed apparatus.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Turning now descriptively to the drawings, in which similar reference characters denote similar elements throughout the several views, and in particular to FIG. 1 thereof. Shown in FIG. 1 is the base wall 12, the angle bracket 90, first wall 100, the second wall 110, the third wall 120, the first pivot 130, the first roller 140, the second roller 142, the third roller 144, the rear bracket 160. the first rear roller 170, the second rear roller 180, the first roll of tape 190, the second reel of tape 200, supplemental roller 210, parallel upright support 300, the forward extending tool 310, the support arms 320, a point where support arms are jointed 340, and the scraping tool 350. The caulking gun is shown comprised of the cannister cradle 70, the trigger mechanism 72, the plunger mechanism 76, the forward wall 72 and the rear wall 74. FIG. 1 also shows a canister of compound 80 retained within the cannister cradle 70.

Shown is an adapter apparatus 10 having a base wall 160. The first end 40 has the first attachment means 20 and a second end 50 having a second attachment means 30. The first attachment means 20 and the second attachment means 30 are both loop clamps that are tied together using a hook and clasp combination 22 or by using a hook and loop or snap fastener combinations. The attachment means 20 and 30 removingly bind the adapter apparatus 10 to a canister cradle 70 of a caulking gun. The intended structural elements to receive the first attachment means 20 is the front wall of the canister cradle 70 and the intended structural element to receive the second attachment means 20 is the back wall 74 of the cannister cradle 70. The first and second attachment means 20 and 30, respectively may be elastic or fabric-based ribbons or bands, or be comprised of more durable materials, such as spastic or metal. Additional or alternative attachment means may also bind the canister cradle 70 and the canister 80.

Figure 2:
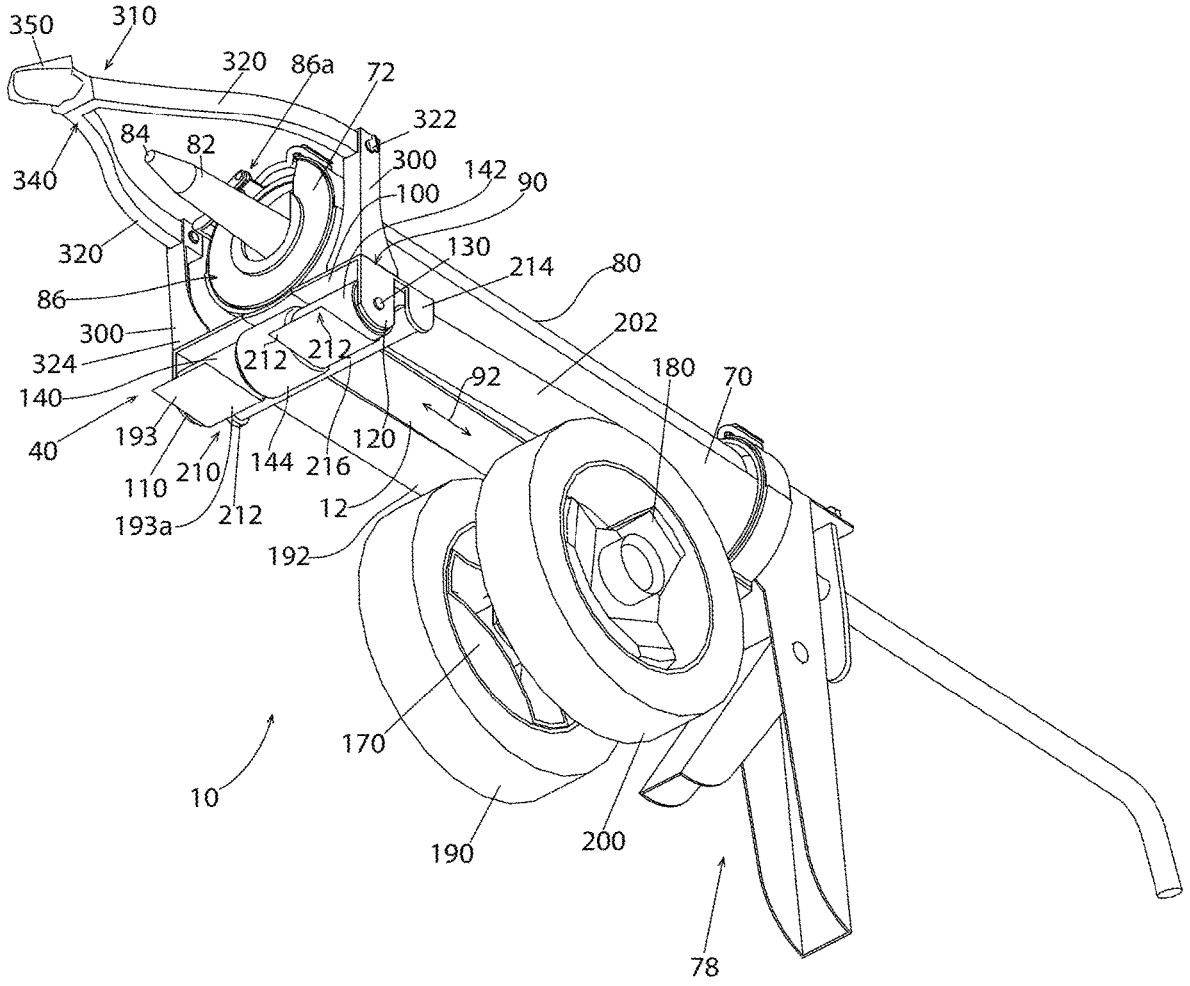
FIG. 2 is another perspective view of embodiment shown in FIG. 1 as viewed from the bottom.

FIG. 2 demonstrates the angle bracket 90. The angle bracket 90 is attached at the first end 40, which corresponds to the front of the caulking gun 86. The angle bracket 90 has a first wall 100 oriented across or perpendicular to the axis 92 of the base wall 12. The first wall 110 and the second wall 120 extend downwardly from free ends of the first wall 100. The first wall 110 and the second wall 120 are in parallel spaced apart confirmation with each other. It is preferred that the first wall 110 and the second wall 120 are flanked by a first supplemental wall 212 and a second supplemental wall 214. The first and second supplemental walls 212 and 214 are in a parallel spaced apart configuration with each other.

Figure 18:
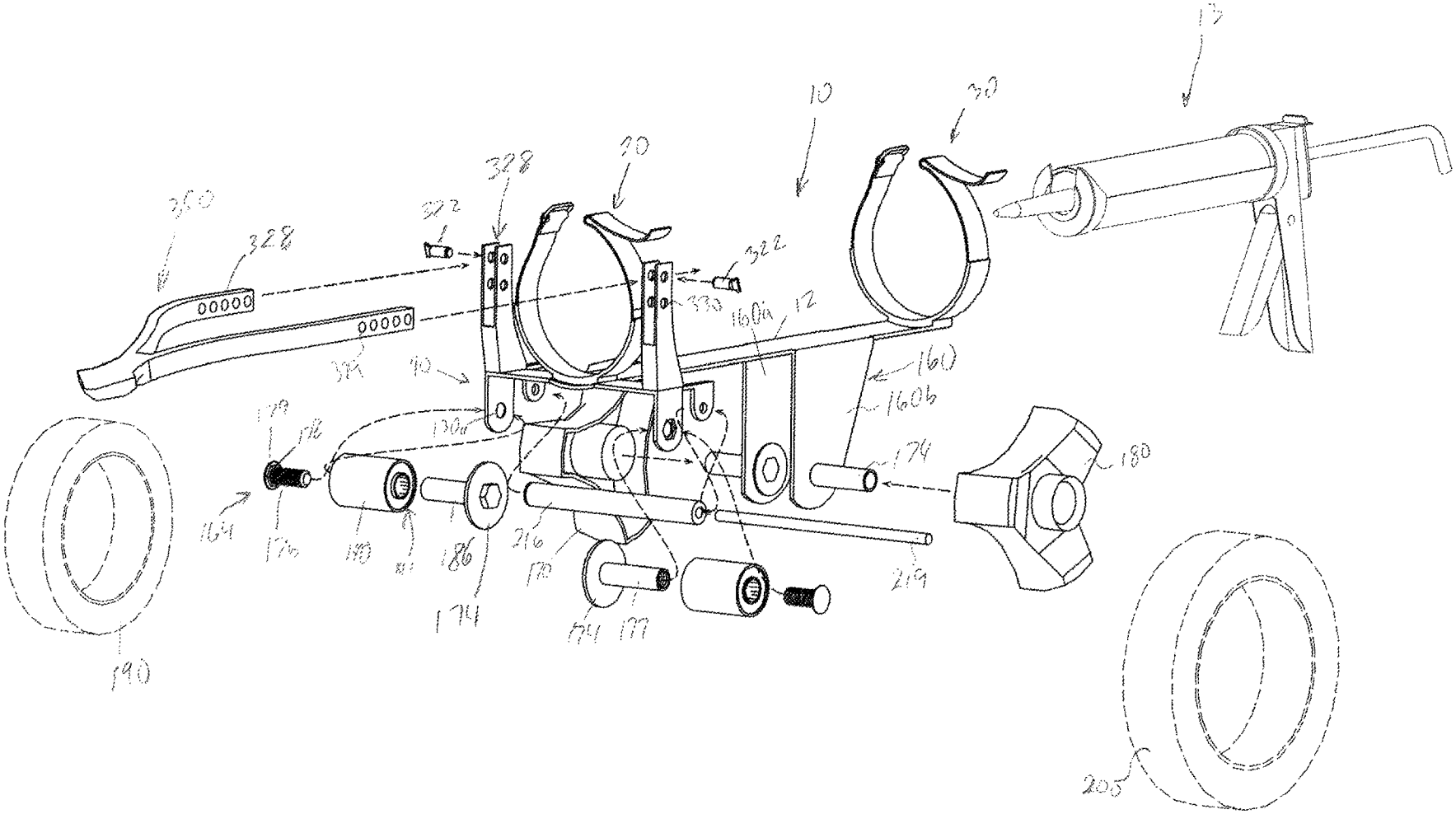
FIG. 18 is a fully exploded view of the embodiment of the apparatus shown in FIG. 16.

The first roller 140 is rotatingly mounted on the first pivot 130. Directly linearly behind the first pivot 130 is the first rear pivot 130. At least one supplemental roller 216 is rotatingly mounted on the supplemental pivot 218 (FIG. 18). The supplemental roller 216 is mounted directly behind the first roller 140. The first rear pivot 130 is configured to accommodate a first roll of tape 190. A ribbon 192 is shown extending from the first roll of tape 190 forward over the at least one supplemental roller 216. The free end of the of the tape 193 is then passed beneath the first roller 140. The first roller 140 is configured to press the adhesive filled surface 193*a* unto the worksurface, as shown in later drawings.

As demonstrated in FIGS. 1 and 2, the disclosed adapter 10 may contain a second roller 142 that is rotatingly mounted on the first pivot 130. The space between the first roller 140 and the second roller 142 is regulated by the third roller 144, which is rotatingly mounted on the first pivot 130 in between the first roller 140 and the second roller 142. While the third roller 144 is shown to be a single component, it may be formed from two or more separate rollers. Thus, to regulate the gap between the first roller 140 and the second roller 142, additional third, rollers 144 may be inserted, or if already mounted, removed. The first pivot 130, the first roller 140, the second roller 142 and the third roller 144 are all removably mounted between the second and third walls 110 and 120, respectively and beneath the first wall 100.

The second rear roller 180 is mounted on the rear bracket 160 on the same linear plain as the second roller 142. The second roll of tape 200 is mounted on the second rear roller 180. A ribbon 202 of tape is then stretched forwardly towards the second roller 142 and is preferably first passed over the at least one supplemental roller 216 and then the free end 203 of the tape directed beneath the second roller 142. The second roller 142 is configured to press the adhesive filled surface 203*a* against a work surface, as shown in figures below.

The bases 324 of the two parallel upright supports 300 are mounted on the first wall 100 and then extend upward to a level that roughly even with the top 86*a* of the cannister cradle 70. The two parallel upright supports accept support arms 320 of the forward extending tool 310. The support arms 320 are curved to avoid the nozzle 82, but are joined at the point 340, which represents the base of the scraper tool 350. The point 340 is preferably approximately 1.2 cm in front of the extruding tip 84. The support arms 320 are retained within the two parallel upright supports 300 using a pin 322, which may also be a press screw or a threaded fastener. It should be appreciated by those skilled in the art that the forward extending tool 310 may be attached directly to the front wall 72 and that only one support arm 320 is required. Also shown in FIG. 2 are the cannister cradle 70, the trigger mechanism 72, the canister 80. Extending through a gap in the front wall 71 is the nozzle 82 of the canister 80, The two parallel upright supports 300 and parallel with each other, with all features being coaxial, or occurring on the same horizontal level.

Figure 3:
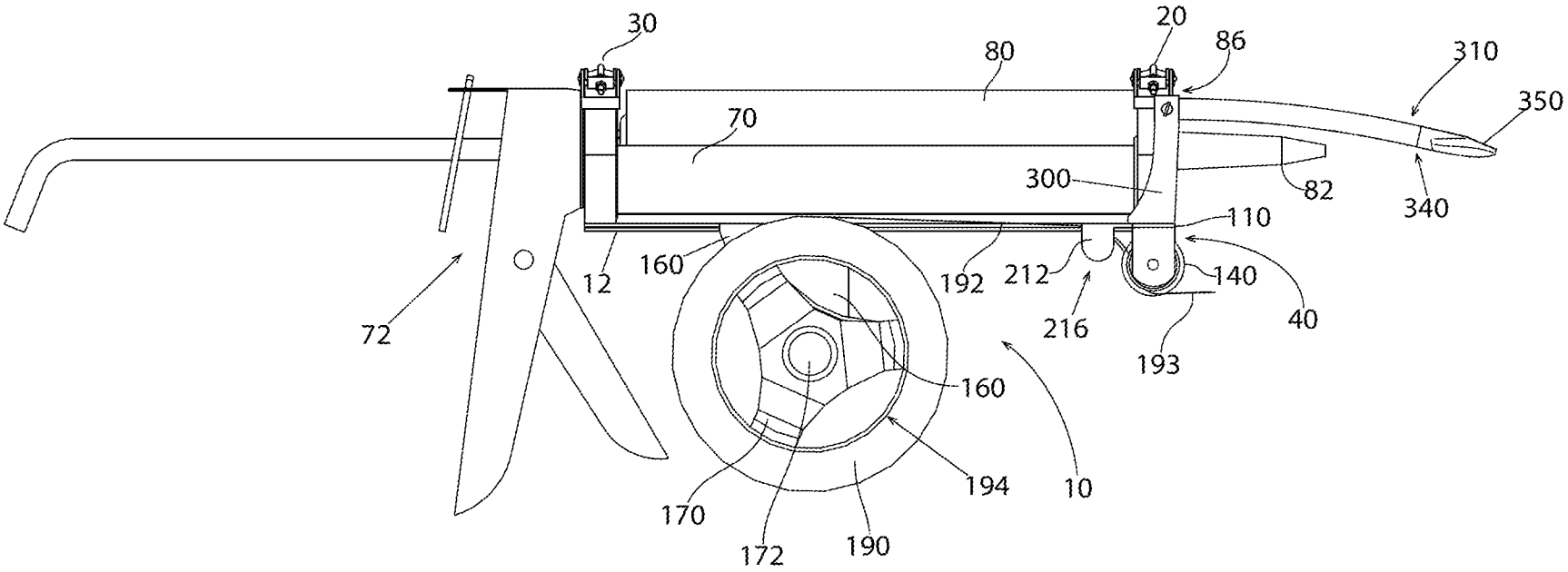
FIG. 3 is a side view of the embodiment shown in FIG. 1.

FIG. 3 shows the sideview of the disclosed, adapter 10. Prominently displayed is the first wall 110, flanked by the first supplemental wall 212. The first wall 110 extends downward from the first wall 100. Extending upward above the first wall 110 is one of the parallel upright supports 300. The first supplemental wall 212 flanks the first wall 110. The tape roller 190 is mounted on the first rear roller 170, with the ribbon of tape 192 extending forwardly over the supplemental roller 216 and then beneath the first roller 140. The first rear roller 170 and the second rear roller 180 (FIG. 2) may be shaped to accept the standard painter's or masking tape diameter 194. Alternatively, a tape roller may be manufactured specifically for the adapter 10, or a different standard tape may be utilized, which may call for an alternative size of the rear rollers 170 and 180. While the first roller 140 and the first rear roller 170 are placed underneath the base wall 12, which itself is mounted beneath the cannister cradle 70, this configuration may be mounted on the top of the cannister cradle 70, with the base wall 12 mounting over the canister cradle 70, with the rear bracket 160 extending upward from the base wall 12, and with the angle bracket 90 being mounted above the cannister cradle 70 substantially near the first end 40.

FIGS. 4A and 4B demonstrate several angles of the adapter 10. Shown is the first attachment means 20 and the second attachment means 30. The first and second attachment means being secured using a clasp 22. The second attachment means 30 and or the first attachment means 20 may be made of more than one portion, such as the lower portion 32 comprising heftier materials, with the top portion 33 being more elastic. The second attachment means 30 is shown mounting on the second end 50 of the base wall 12, or alternatively anywhere along the length of the base wall 12. Similarly, the first attachment means 20 may be made from more than one portion, such as a hefting and more elastic portions. The first attachment means 20 mounted at the first end 40. Alternatively, magnets or adhesive surfaces may be implemented to combine the adapter 10 with the canister cradle 80, replacing one or both of the attachment means 20 and 30.

The rear bracket 160 is shown comprised of two downwardly extending members, the first rear bracket member 160*a* and the second rear bracket member 160*b*. Alternatively one downwardly extending member may replace the first and second rear bracket members 160*a* and 160*b*. The pivots of the angled bracket 90 and the rear bracket 160 are oriented at right angle 96 with the axis of the base wall 12. It should be appreciated by one skilled in the art that the base wall 12 may be replaced with two or more segments mounting individual components. For example, the rear segment may be utilized to mount the rear bracket 160 and the rear attachment means 30, and the front segment may be utilized to mount the angled bracket 90 and the two upright supports 300.

Also shown in FIGS. 4A and 4B are the first wall 110, the second wall 120, the first pivot 130 the first supplemental wall 212, the second supplemental wall 214, the at least one supplemental roller 216, the first roller 140, the second roller 142 and the third roller or rollers 144. The forward extending tool 310, the support arms 320, the point 340 and the scraping tool 350, which is shown as being a spade like tool, but which may be any alternatively shaped scraping, compacting, application or cleanup tool. The supplemental roller 216 may encompass the entire width of the first, second and third rollers 140, 142 and 144, respectively, or there may be several adjacent supplemental rollers 216.

The third roller 140 is configured to be placed within a seam or groove to which compound is being applied, and then serve as a guide for the adapter 10 to ensure that the deployment of the tape and the application of the compound bead does not deviate unto the adjacent walls For this purpose, it is preferred that the third roller or rollers 140 is of greater cross-sectional diameter than the first, or second rollers 140 and 142.

Figure 5:
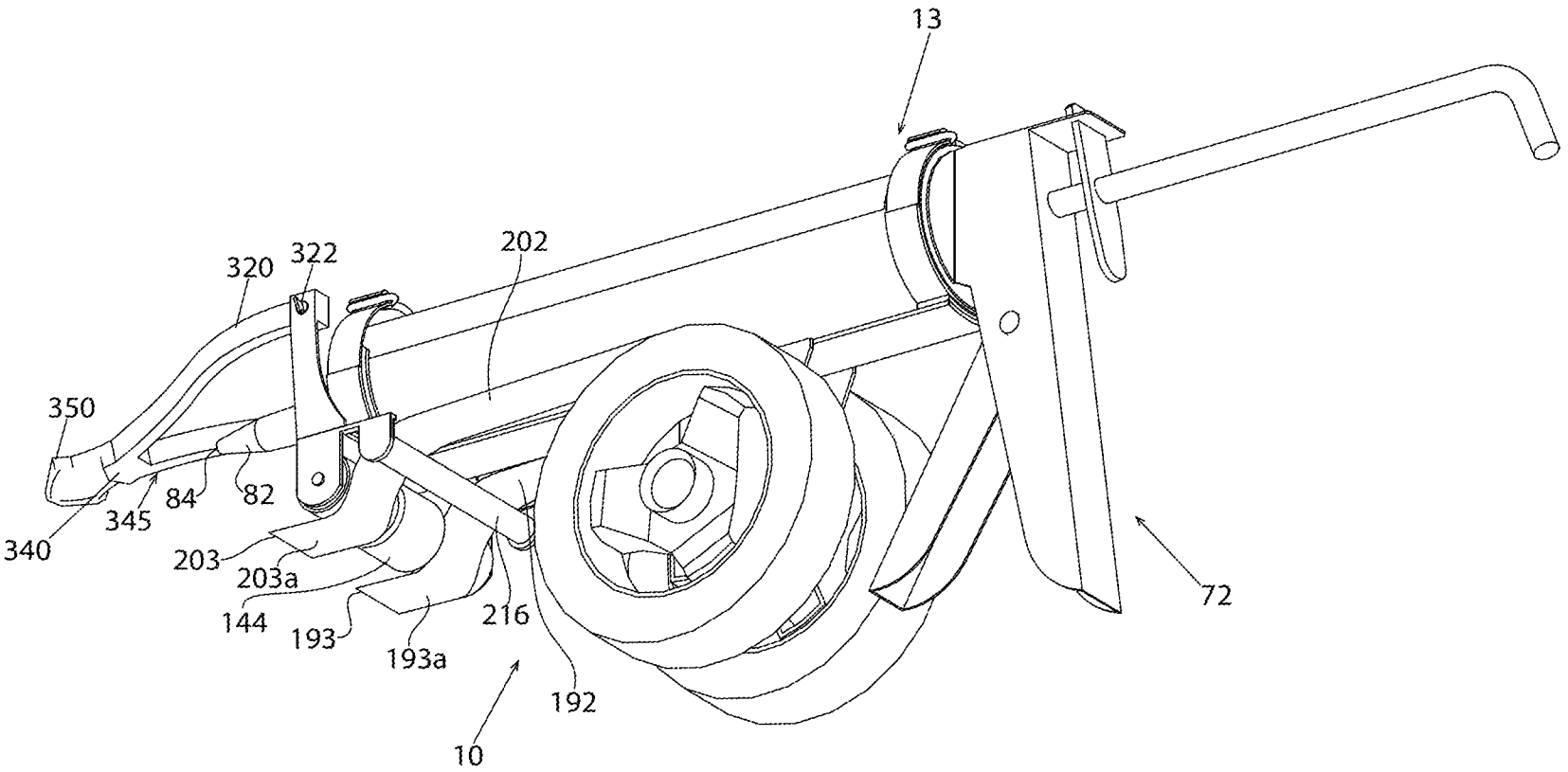
FIG. 5 is the rear perspective view of disclosed apparatus.

FIG. 5 is a rear perspective view of the disclosed adapter 10 and the caulking gun 13, as viewed from the trigger side 72. The supplemental roller 216 serves as a lower support for the tape segments 192 and 202. It is preferred that the cross-sectional diameter of the supplemental roller 216 is smaller than that of the first and second rollers 140 and 142. The free ends of the tape segments 193 and 203 then pass beneath the first and second rollers 140 and 142. The third roller 144 is thicker than either the first or the second roller 140 and 142.

The gap 345 separates the extruding tip 84 of the nozzle 82 from the point 340, which is the base of the scraping tool 350. The gap is preferably between 1 and 4 centimeters and may be adjustable in distance and elevation with respect to the, extruding tip 84, as shown in alternative embodiments.

Figure 6:
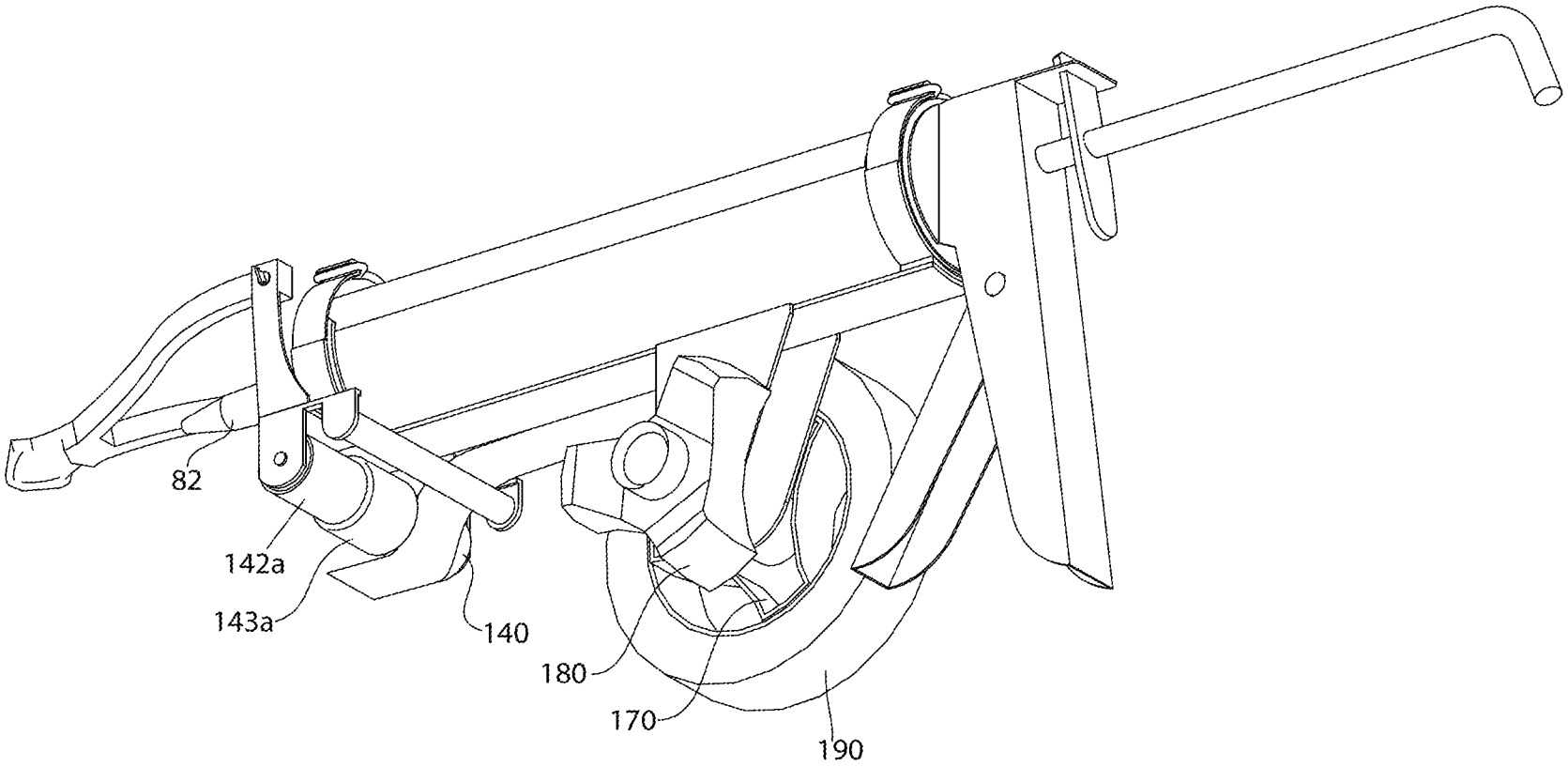
FIG. 6 is an apparatus showing only one side of rollers supporting a tape.

FIG. 6 is essentially the same view as presented in FIG. 5, but with only the first roller 140 and the second roller 170 having a tape roll 190 deployed thereon. While the second and third rollers 142 and 144, respectively are shown, as well as the second rear roller 180, these elements may be removed or not provided altogether, with adapter shown capable of deploying tape to only one side of the nozzle 82. FIG. 6 demonstrates that the tread 143*a* of the third roller 144 extends past the treat 142*a* of the second roller 143, and is therefore able to be pressed into a seam where a quantity of a compound is being extruded to using the disclosed device.

Figure 7:
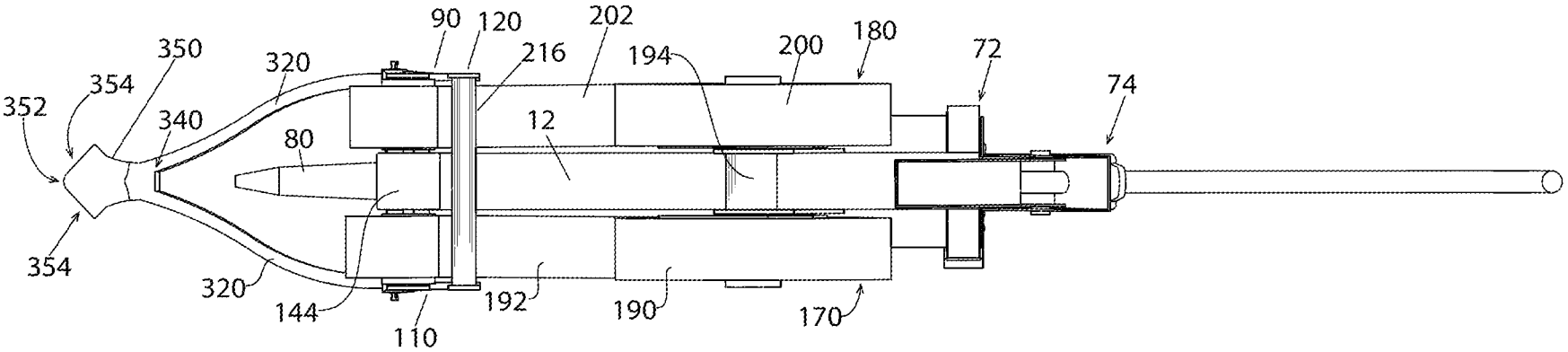
FIG. 7 is a bottom view of the disclosed apparatus bound to a caulking gun.

FIG. 7 bottom view of the described invention. Shown is the plunger mechanism 74, the trigger mechanism 72, the base wall 12 the angled bracket 90, the first rear roller 170 and the second rear roller 180 with a rear pivot 174. The first and second rear rollers 170 and 180, having the first and second rolls of tape 190 and 200 deployed thereon. The supplemental roller 216 is mounted between he first wall 110 and the second wall 120 and functions as a guide for the tape segments 192 and 202. Also shown is the third roller or rollers 144. The support arms 320 are curved outward so as to avoid the nozzle 80 and come together at a point 340. The forward extending tool 350 is shown as a spade tool, having angled edges 354 and a leading point 352. The leading point 352 compresses a bead of compound extruded by the nozzle 80, while the angled edges 354 scrape of access compound accumulating after application of the leading point 352. The forward extending tool 350 may also be a roller, a scrapper, a trowel, a spatula, a sponge, a brush or any other tool that may foreseeably be used by a technician utilizing the disclosed device.

Figure 8:
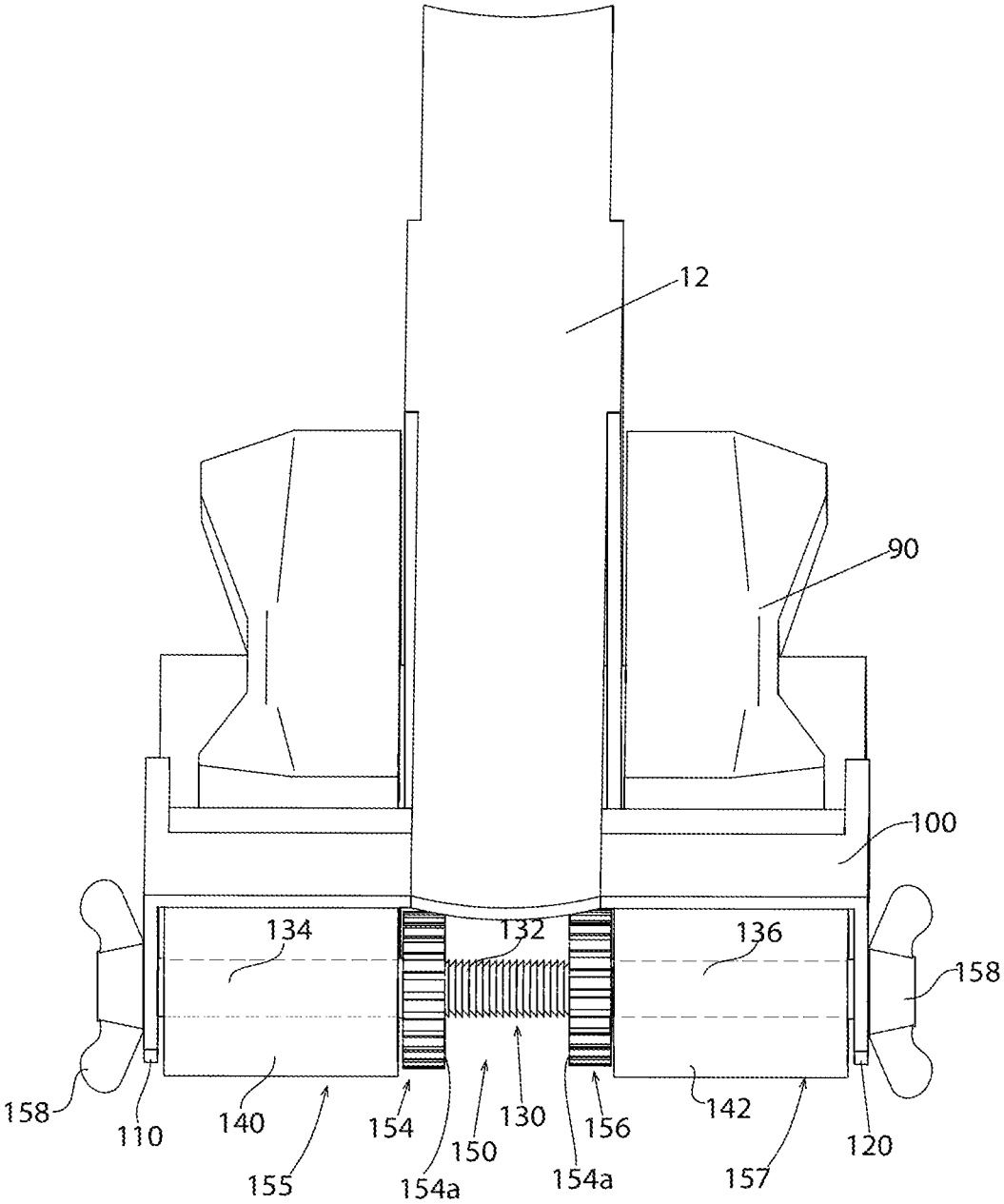
FIG. 8 is another embodiment of the disclosed angle bracket.

FIG. 8 demonstrates the first alternative embodiment of the adapter 10, namely an alternative embodiment of the first pivot 130. In the embodiment shown, the first pivot 130 contains threading 132. The threading is engaged by the first adjustment wheel 154 and by the second adjustment wheel 156. Each first adjustment wheel 154 and second adjustment wheel 156 are in a parallel and spaced apart configuration with each other, producing a gap 150, which would correspond to the width of a groove of a workspace. Attached obliquely each the first adjustment wheel 154 and the second adjustment wheel 156, is a sleeve 134 and the sleeve 136, respectively. The first roller 140 is then rotatingly and removably mounted onto the sleeve 134, while the second roller 142, if one is present, is mounted on the sleeve 136. The first adjustment wheel 154 and the first sleeve 134 that is attached to it creates the first roller cradle 155, while the second adjustment wheel 156, creates the second roller cradle 157. The first pivot 130 is retained within the first wall 110 and within the second wall 120 using winged nuts 158. The gap 150 can be adjusted by turning the first adjustment wheel 154 or the second adjustment wheel 156 along the thread 132 to widen or narrow the gap 150.

Figure 9:
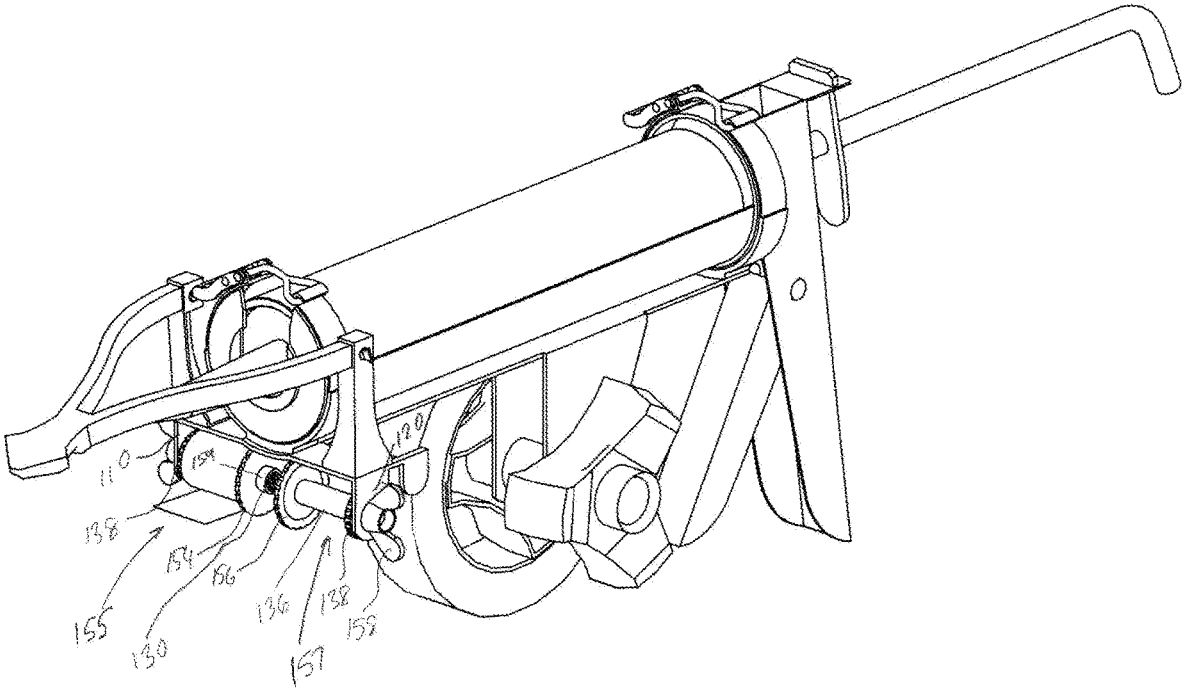
FIG. 9 is a perspective view of the embodiment of the angle bracket shown in FIG. 8.

A roller cradle is clearly visible in FIG. 9, which shows the second roller cradle 157. The second roller cradle 157 is comprised of an adjustment wheel 156 which obliquely contains a second sleeve 136 between it and the third wall 120. The second sleeve 136 is in a parallel spaced apart configuration with the first pivot 137. Similarly, the first adjustment wheel contains an obliquely mounted first sleeve 134 between it and the second wall 110. Also shown in FIG. 9 are the terminal wheels 138 on the opposite ends of the first horizontal sleeve 134 and the second horizontal sleeve 136. The terminal wheels 138 are in a parallel spaced apart configuration with respect to the first pivot 130. Each the first roller cradle 155 and the second roller cradle 157 are shifted along the length of the first pivot 130, by rotating the first adjustment wheel 154 or the second adjustment wheel 156, respectively.

Figure 10:
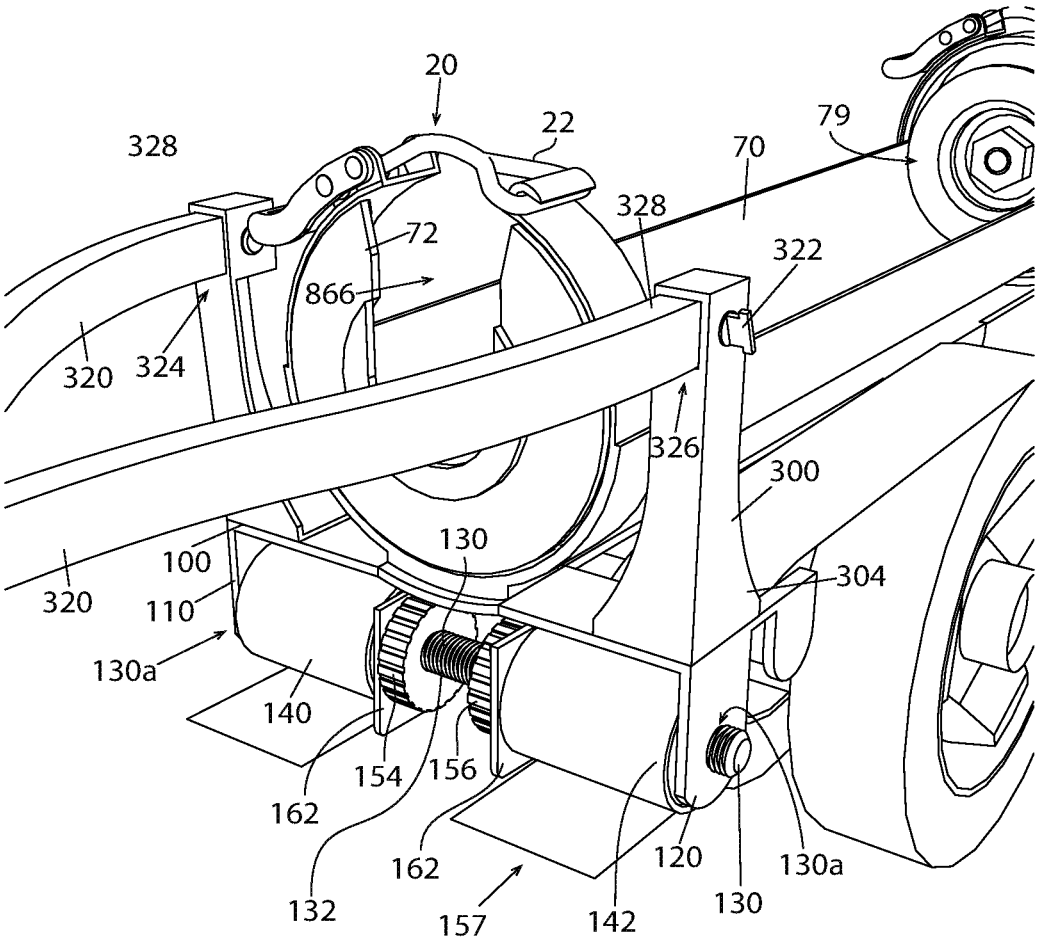
FIG. 10 is another embodiment of angle bracket shown in FIG. 8.

FIG. 10 is another alternative embodiment showing guide plates 162 between each the first adjustment wheel 154 and the first roller 140, and in the case of the second roller cradle 157, between the second adjustment wheel 156 and the second roller 142. The fist pivot 130 is threaded and is threadeningly mounted through the first opening 130*a* and the second opening 130*b*. The first opening 130*a* and the second opening 130*b* both contain threading corresponding to the threading 132 of the first pivot 130.

Also shown in FIG. 10 are the base 324 of the upright parallel supports 300, the forward facing opening 326 is mounting the free ends 328 of the support arms 320. The free ends 328 being retained within the forward facing openings 326 using pegs or pins 322. The cannister holding cradle 70 of the caulking gun showing the plunger 79 the front wall 72 and the opening for the nozzle 86*b*.

Figure 11:
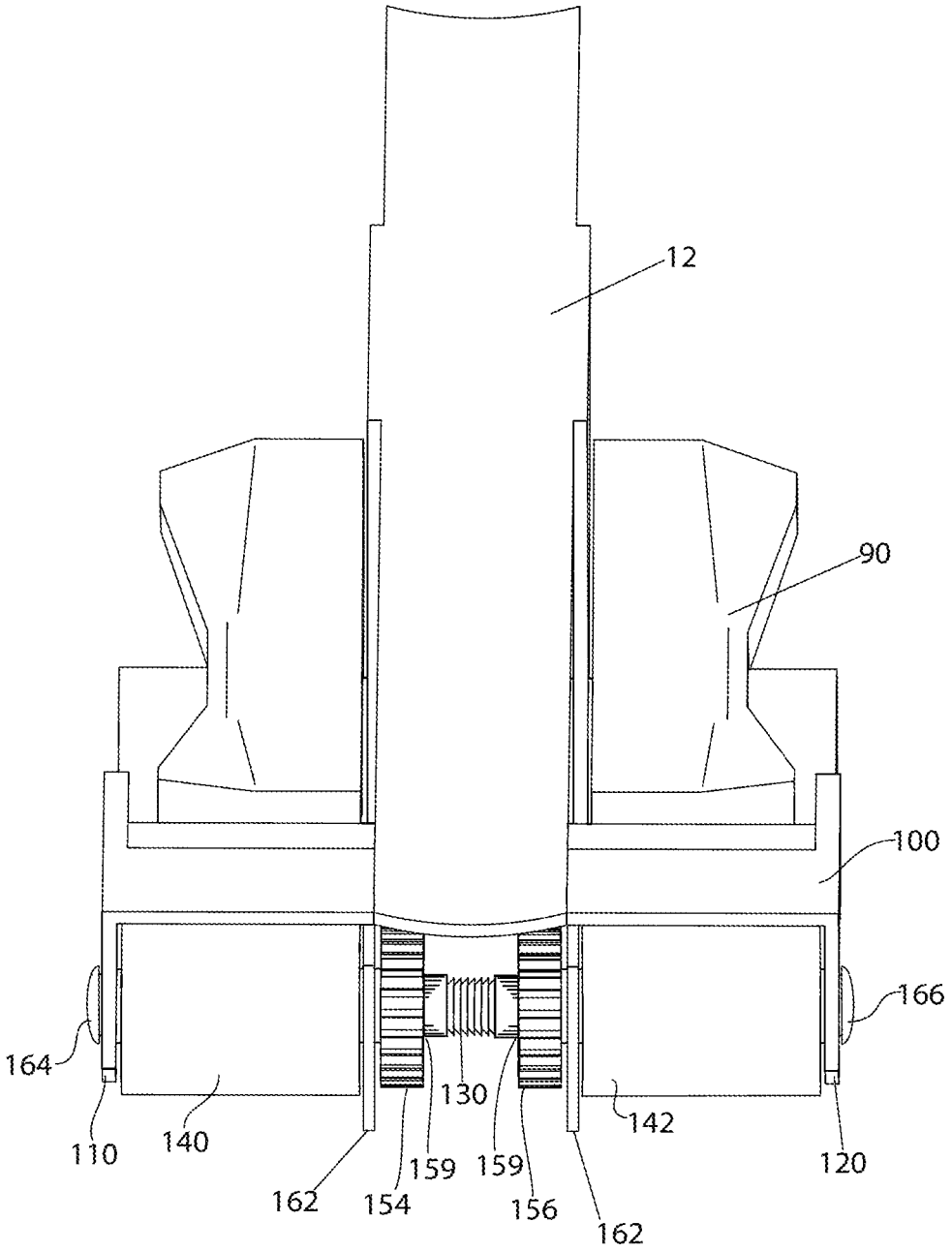
FIG. 11 is a front view of the disclosed invention shown in FIG. 8.

Some of the alternative embodiments are further demonstrated in FIG. 11. Shown is the base wall 12, the angle bracket 90, the first wall 100, the second wall 110, the third wall 120, the first roller 140, the second roller 142. The first adjustment wheel 154 connected to the collar 159 which is in a threaded association with the first pivot 130, and the second adjustment wheel 154 connecting to the collar 159 that is a threaded association with the first pivot 130. The collars 159 of the first and second adjustment wheels 154 and 156 being opposite each other. The wing nuts 158 have been replaced by the first fastener 164 and the second fastener 166. The guide plates 162 have been inserted onto first and second sleeves 134 and 136 (see previous figs.) and are preferably substantially immobilized adjacently to first and second sleeves 134 and 136 using silicon or rubber gaskets.

Figure 12:
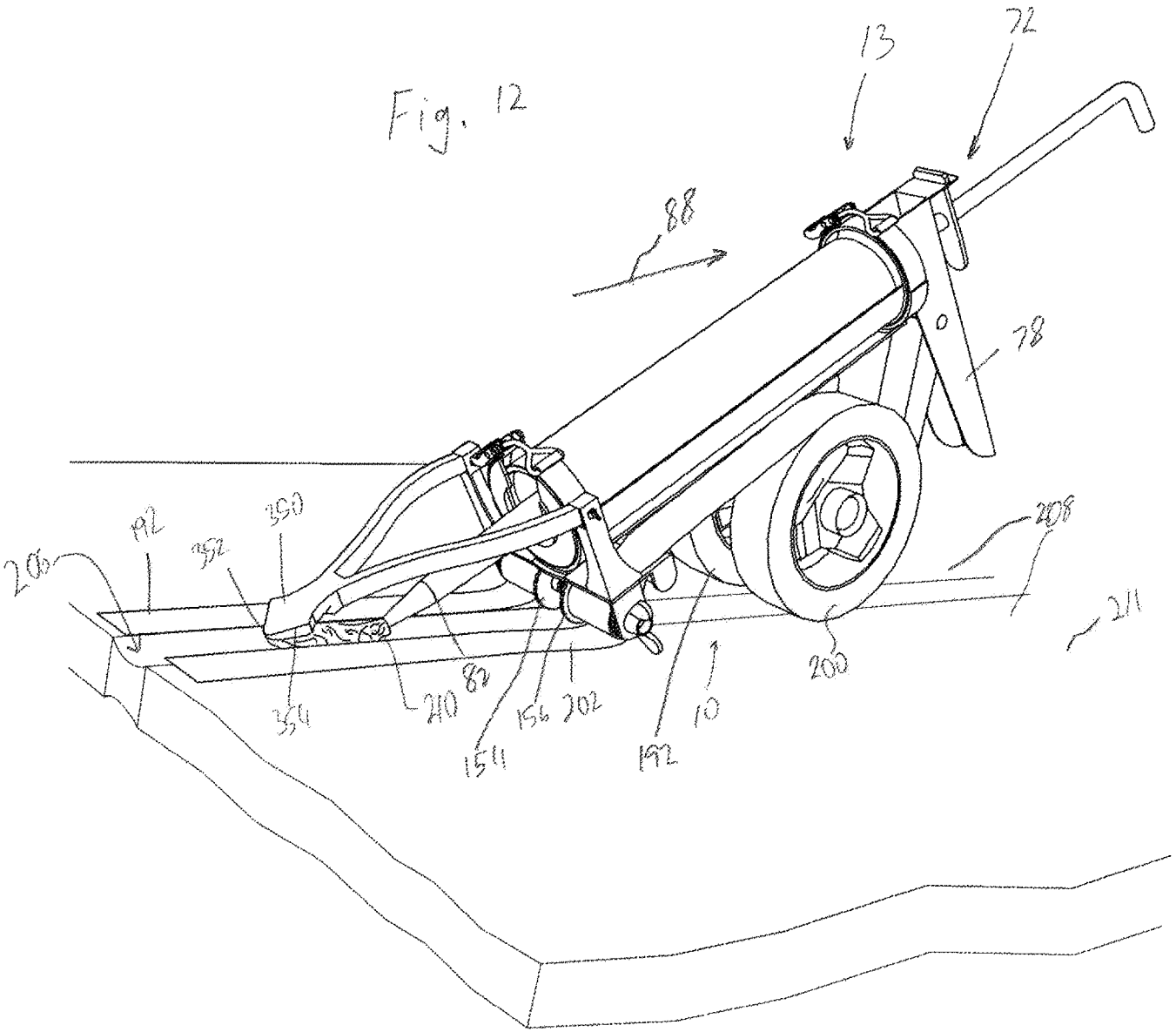
FIG. 12 is a contextual view of the device disclosed in FIG. 8 shown in a contextual setting.
Figure 13:
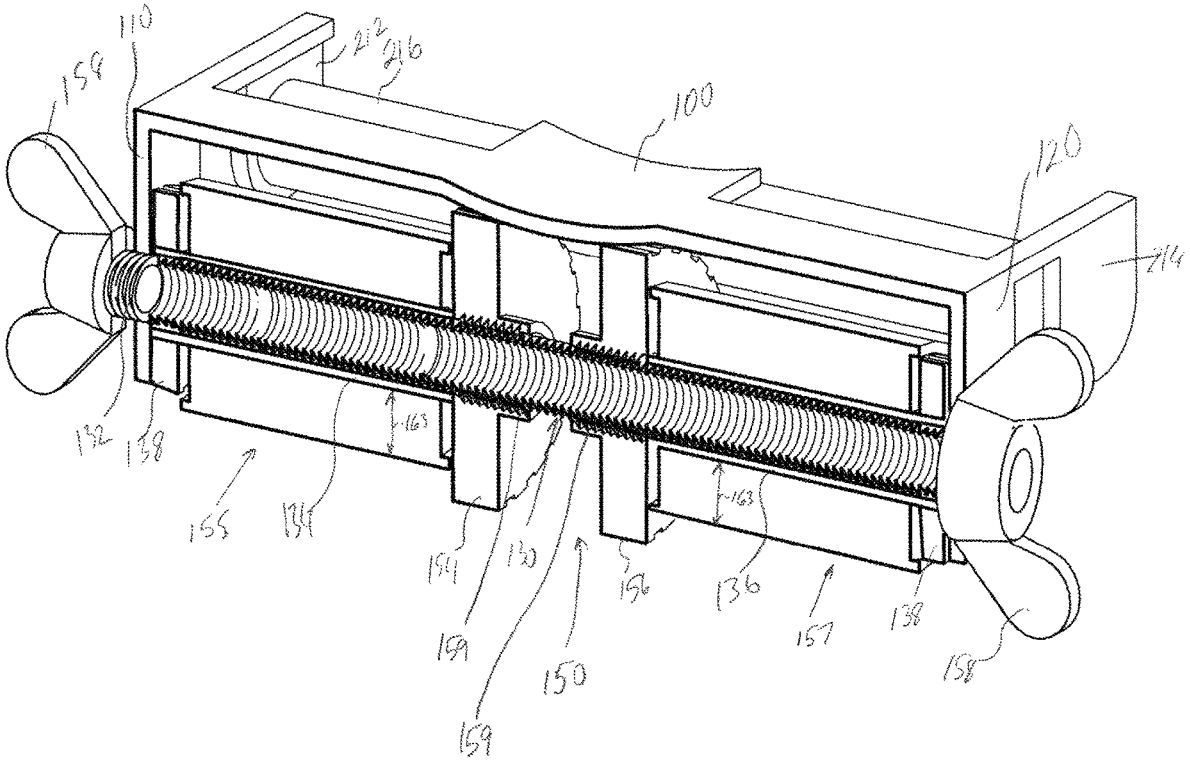
FIG. 13 is a cutaway diagram of the device disclosed in FIG. 8.

FIG. 12 is a contextual demonstration of the disclosed adapter 10 assisting in the operation of the caulking gun 13. The caulking gun 78 is being pulled using the trigger handle 78 in the direction 88. As caulking gun moves in the direction 88, a quantity of filling compound 210 is extruded into a groove 206. FIG. 12 demonstrates the sequence of operation of the disclosed adapter 10. First, the first roller 140 and the second roller 142 are rolled along edges 208 adjacent to the groove 206. As the first and second rollers 140 and 142 progress along the work surface 211, they draw tape ribbons 192 and 202 and press it along the edges 208, The nozzle 82 follows, extruding a quantity of compound into the groove 206. The forward facing tool 350 is then the last step. The forward facing tool shown is the spade like trowel having the forward tip 352, which forced the compound bead 210 into the groove 206. Excess compound is spread apart by angled edges 354, which also cutaway access compound or deposit it along the taped edges. At the end of this task, a user need only to lift the tape to remove the access compound. The first adjustment wheel 154 and the second adjustment wheel 156 in FIG. 12 are shown to have a larger diameter than the first and second rollers 140 and 142, and as such the adjustment wheels 154 and 156 double as guides for the adapter 10, to maintain centricity of the adapter with respect to the groove 206. The work surface 211 may be drywall, tile, or exterior or interior paneling, FIG. 13 is a cutaway diagram demonstrating the details of the roller cradles disclosed in the embodiment of the invention shown in FIG. 8. Shown is the first wall 100 the second wall 110 and the third wall 120. Also shown is the first supplemental wall 212 and the second supplemental wall 214. A supplemental roller 216 disposed behind the first roller 140 and the second roller 142. The first pivot 130 is threaded for its entire length of the first pivot A first roller cradle 155 is comprised of the first adjustment wheel 154, with a first sleeve FIG. 13 is a cutaway diagram demonstrating the details of the roller cradles disclosed in the embodiment of the invention shown in FIG. 8. Shown is the first wall 100 the second wall 110 and the third wall 120. Also shown is the first supplemental wall 212 and the second supplemental wall 214. A supplemental roller 216 disposed behind the first roller 140 and the second roller 142. The first pivot 130 is threaded for its entire length of the first pivot. A first roller cradle 155 is comprised of the first adjustment wheel 154, with a first sleeve 134 attached obliquely to the first adjustment wheel 154 and terminated by the terminal wheel 138. Of all components, the only component being in a threaded association with the first pivot 130 is the first adjustment wheel 154. The first sleeve 136 and the, terminal wheel 138, which are all obliquely attaching to the first adjustment wheel 154 and being in a parallel and spaced apart configuration with the first pivot 130. A first roller 140 is then rotatedly mounted on the first sleeve 136.

In an embodiment requiring two front rollers, the second roller cradle 157 is disposed on the first pivot 130 adjacent to the first roller cradle 155. Similar to the first roller cradle 156, the second adjustment wheel 156 is threadedly mounted onto the first pivot 130, with the second sleeve 136 obliquely attaching to the second adjustment wheel 156 and terminated by the terminal wheel 138. The second roller is then rotatingly mounted on the second sleeve 136. In the embodiment shown, the threaded surface of the first and second adjustment wheels 154 and 156 respectively, is further extended to, or alternatively, limited to, the collar 159. The diameter of the first and second adjustment wheels 154 and 156, respectively, is greater than the diameter of the thickness 163 of the first and second rollers 140 and 142, respectively, thus serving as guides to maintain the centricity of the adapter 10 with respect to the groove being caulked.

Figure 14:
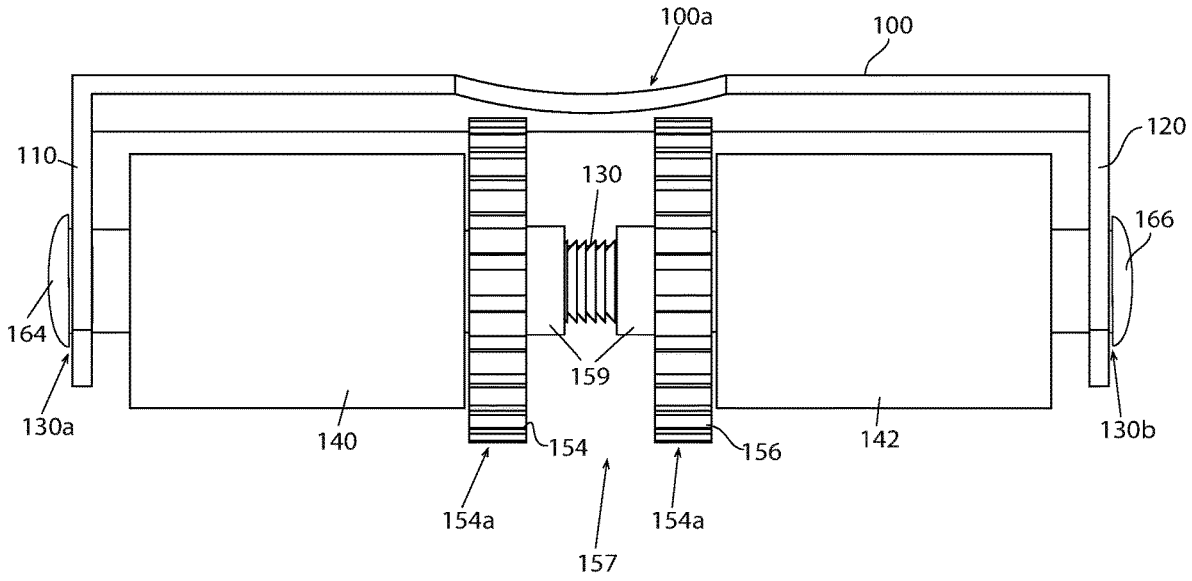
FIG. 14 is an alternative embodiment of angle bracket shown in FIG. 8.

The terminal wheels 138 and wingnuts 158 may be replaced by the first fastener 164 and the second fastener 166. The cup head 165*a* of the first and second fasteners 164 and 166 is of lower profile than the wingnuts 158, permitting access of the device in tight spaces, The treads 154*a* of the first and second adjustment wheels 154 and 156, respectively is configured to be gripped by a hand for adjustment, and thus offers a ribbed surface for a better grip. The treads 154*a* may be made of the same materials as the adjustment wheels 154 and 156 or made of rubber, silicone or other polymeric surfaces. Also shown in FIG. 14 is the first wall 100, the second wall 110, the third wall 120, the first opening 130*a*, the second opening 130*b*, the first roller 140 and the second roller 142. The center concave section 100*a* of the first wall 100, offers a better fit with the generally cylindrical shape of the cannister cradle 70.

Figure 15:
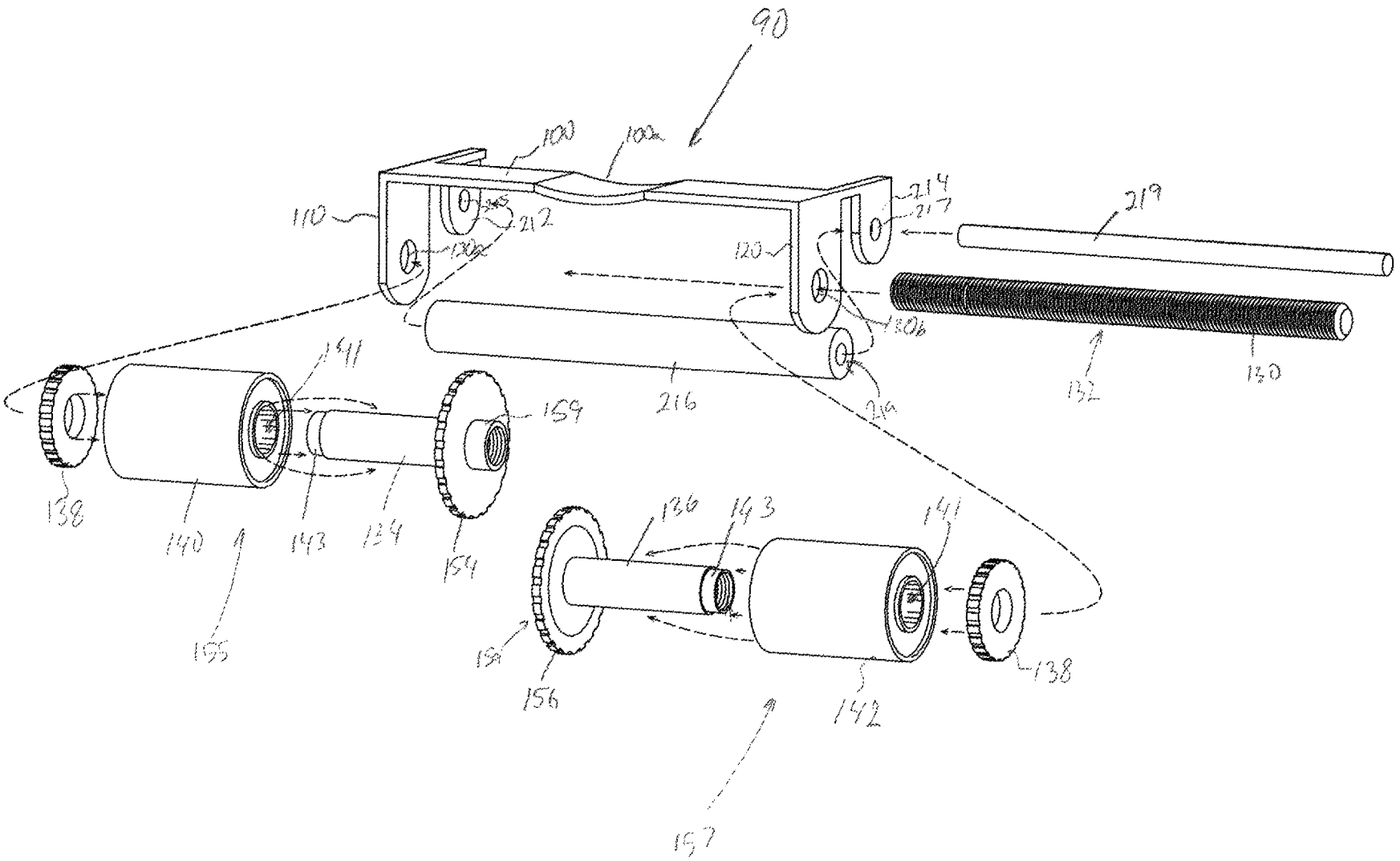
FIG. 15 is an exploded diagram of the angle bracket embodiment shown in FIG. 8.

FIG. 15 is an exploded diagram of the angle bracket 90. Shown is the first wall 100 the second wall 110, the first opening 130*a*, the supplemental wall 212 and the first supplemental opening 215; the second wall 120 and the second opening 130*a*, the second supplemental wall 214 and the second supplemental opening 217. The supplemental pivot 217 is mounted across the first supplemental opening 215 and the second supplemental opening 217. The supplemental pivot 217 is threaded through the shaft 219 of the supplemental roller 216, within the supplemental roller 216 remaining in a rotational association with the supplemental pivot 219.

In the forward section of the angle bracket 100, the first pivot is mounted across the first opening 130*a* and the second opening 130*b*, both of which may contain threading to coincide with threaded surfaces of the threaded surface 132 of the first pivot 130.

The disassembled first roller cradle 155 is comprised of the first adjustment wheel 154, having a threaded collar 159 on one side and obliquely mounted first shaft 134 on the other side. The first shaft 134 passes the through channel 141 in the first roller 140. The first shaft 134 then connects to a terminal wheel 138 with a setting 143.

The disassembled second roller cradle 157 is comprised of the second adjustment wheel 156, having a second sleeve 136 obliquely attached on one side with a collar 159 on the other side of the second adjustment wheel 156. The second sleeve 136 passes through the channel 141 of the second roller 142 and terminates inside the terminal wheel 138.

The extension and the elevation of the forward extending tool 350 are adjustable using the support arms 320 and the parallel upright supports 300. Elevational adjustment is enabled by lengthening the forward facing openings 326. The fastener or pin holes 330 are then used to raise or lower the support arms 320 along the height of the forward facing openings 326. The extension of the forward facing tool 35 can simultaneously be made using the openings 329 that are present at regular intervals along the terminal ends 328 of the support arms 320. The terminal ends 328 move within the forward facing openings 326 until a desired degree of extension is achieved. Both the elevation and the extension of the forward facing tool 350 is then secured using the pins or fasteners 322.

Figure 16:
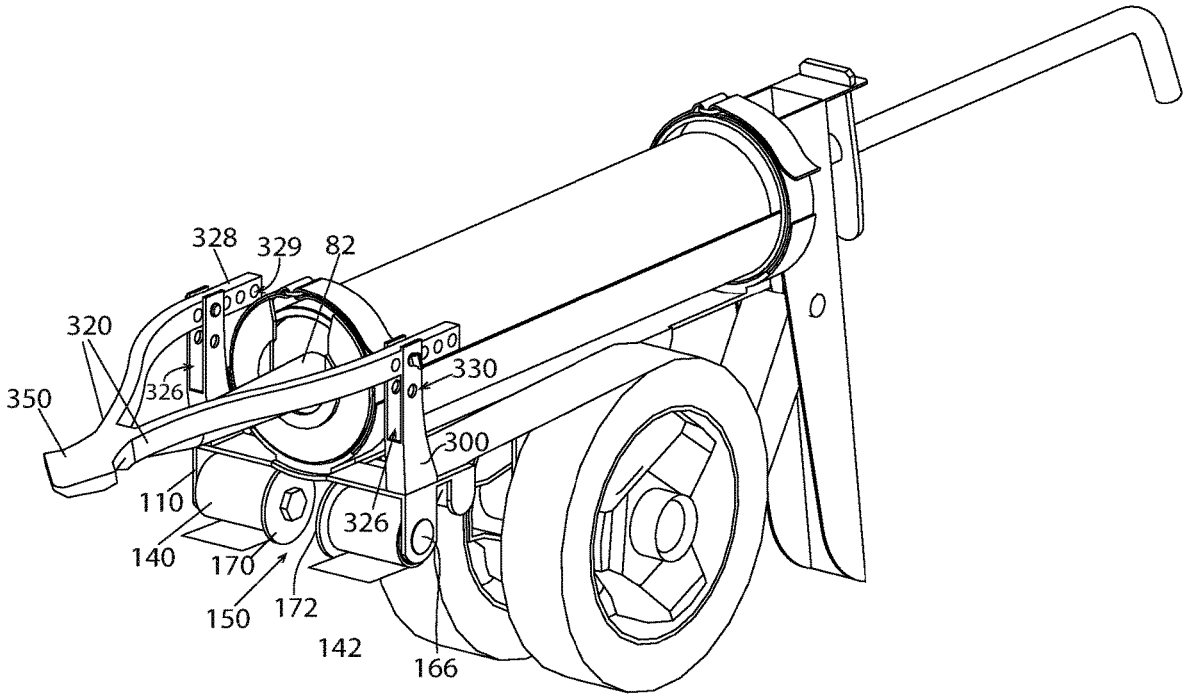
FIG. 16 is another embodiment of the disclosed apparatus.

FIG. 16 further describes an additional embodiment of the invention. Shown is the first roller 140 and the second roller 142. The first roller 140 is independently secured to the first wall 110. The second roller 142 is secured to the second wall 120. The first roller 140 is axially independent and not connected with the second roller 142. The gap 150 between the rollers is left empty and may be used to deploy a first vertical flange 170 at the first roller 140 and deploy the second vertical flange 172 at the second roller 142. The first roller 140 is secured to the first wall 110 using the first fastener 164 and the second roller is secured to the second wall 120 independent of the first roller 140, using the second fastener 166.

Figure 17:
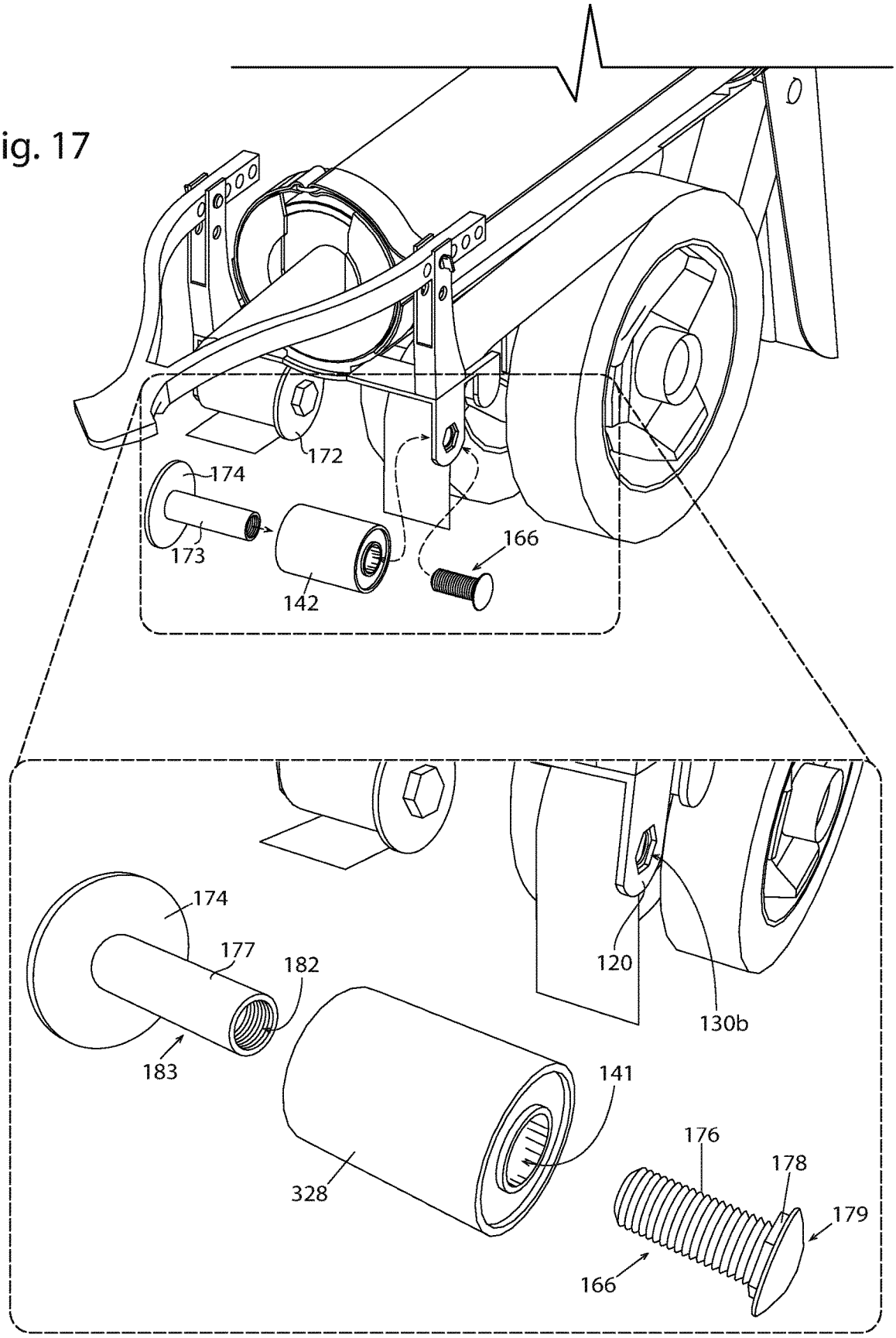
FIG. 17 is an exploded close-up view of the embodiment disclosed in FIG. 16.

FIG. 17 is an exploded view of thew alternative embodiment shown in fig, 16. In this embodiment, it is possible to install and remove the first roller 140 independent of the second roller 142 and visa versa. Shown in FIG. 17 is the second fastener 166 having a cupped or flange head 179. Beneath the head 179 is a key connector 178 configured to fit within the socket opening of the second opening 130*b*. In this case, the second opening 130*b* forms a hexagonal socket for the hexagonal key of the second fastener 166. The hexagonal socket 130*b* locks the second fastener 166 within it. A complimentary component is also formed from a combination of the second vertical flange 174 and the second horizontal shaft 177. The end portion 183 of the second horizontal shaft 183 contains threading 182 that is used to secure both the second vertical flange 174 and the second horizontal shaft 177 to the second wall 120 using the threaded member 176 of the second fastener 176. The second horizontal shaft 177, prior to linkage with the second fastener 166 passes through the channel 141 of the second connector, with the channel 141 and the second horizontal shaft 177 being in a rotating association with each other. While FIG. 17 is focused on the second roller 142, the first roller is likewise attached to the second wall 110 using the first fastener 164, which is locked in within the socket-like first opening 1301, with the first horizontal shaft and the first vertical flange combination linking with the threaded portion 176 of the first fastener 164, with the first horizontal shaft 186 first passing through the channel 141 of the first roller 140, with the channel 141 and the first horizontal shaft 173 being in a rotational configuration with each other.

FIG. 18 is an exploded diagram of the entire adapter 10, separately demonstrating a loaded caulking gun 13. In this diagram, the first and second attachment means 20 and 30, respectively are preferably a hook and loop connector deployed of a ribbon that doubles over itself the lock the hook and loop connector together. The rear angled bracket 160 is shown comprising the first rear bracket 160*a* and the second rear angled bracket 160*b*. The rear shaft 194, which may be broken up into two shafts 194*a* and 194*b* separately mounted on the rear angled bracket 160. The first rear roller 170 attaching to the first rear angled bracket 160*a*, and the second rear roller 180 attaching to the second rear angled bracket 160*b*. The angled bracket 90 is assembled having a first vertical flange 174 and horizontal shaft 186 connecting through the first roller 140 to the first fastener 164. The first fastener is mounted within the first opening 130*a* using the key hexagonal shape 178. Similarly, the second vertical flange 176 and second horizontal shaft 177 connecting through the second roller 142 to the second fastener 166 to the second opening 130*b*. The supplemental shaft 219 mounting across the first and second supplemental openings 215 and 217, respectively, mounting the supplemental roller 216. I should be noted that the supplemental shaft may alternatively be in the same shape as the first and second rollers 140 and 142, with the cross-sectional diameter of the supplemental roller 216 being smaller or larger than the cross-sectional diameter 140 and 142. The rollers may preferably be made from hard or soft plastic, rubber, metal or wood.

Also shown in FIG. 18 is the forward extending tool 350, terminal ends 328, and forward facing opening 328. The elevation and extension of the forward extending tool 350 is adjustable by selecting the appropriate openings 330 with openings 329 and removably securing these with the pin or fastener 322.

Figure 19:
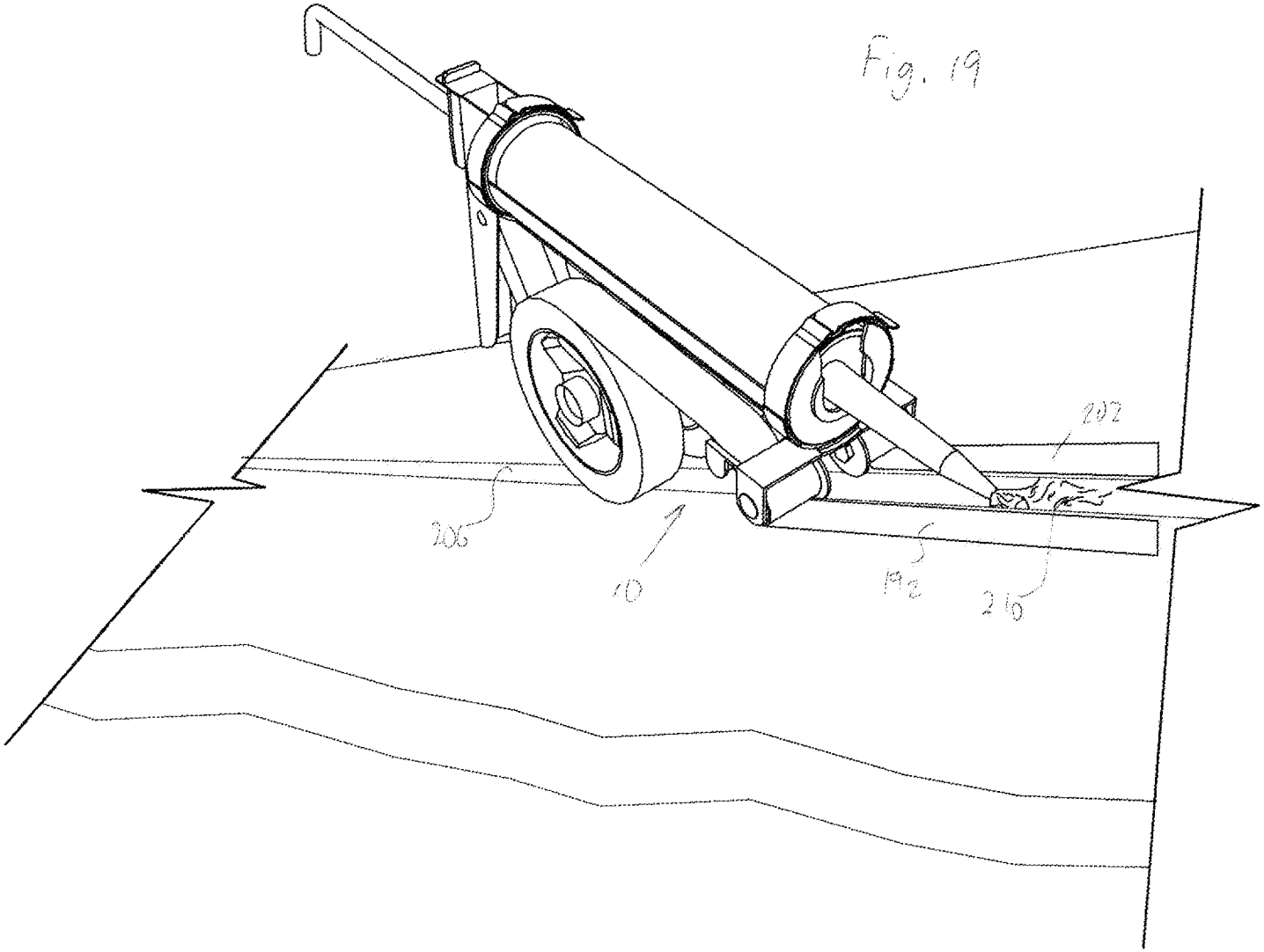
FIG. 19 is a contextual view if the embodiment of the apparatus shown in FIG. 16, shown without the scraping tool.
Figure 20:
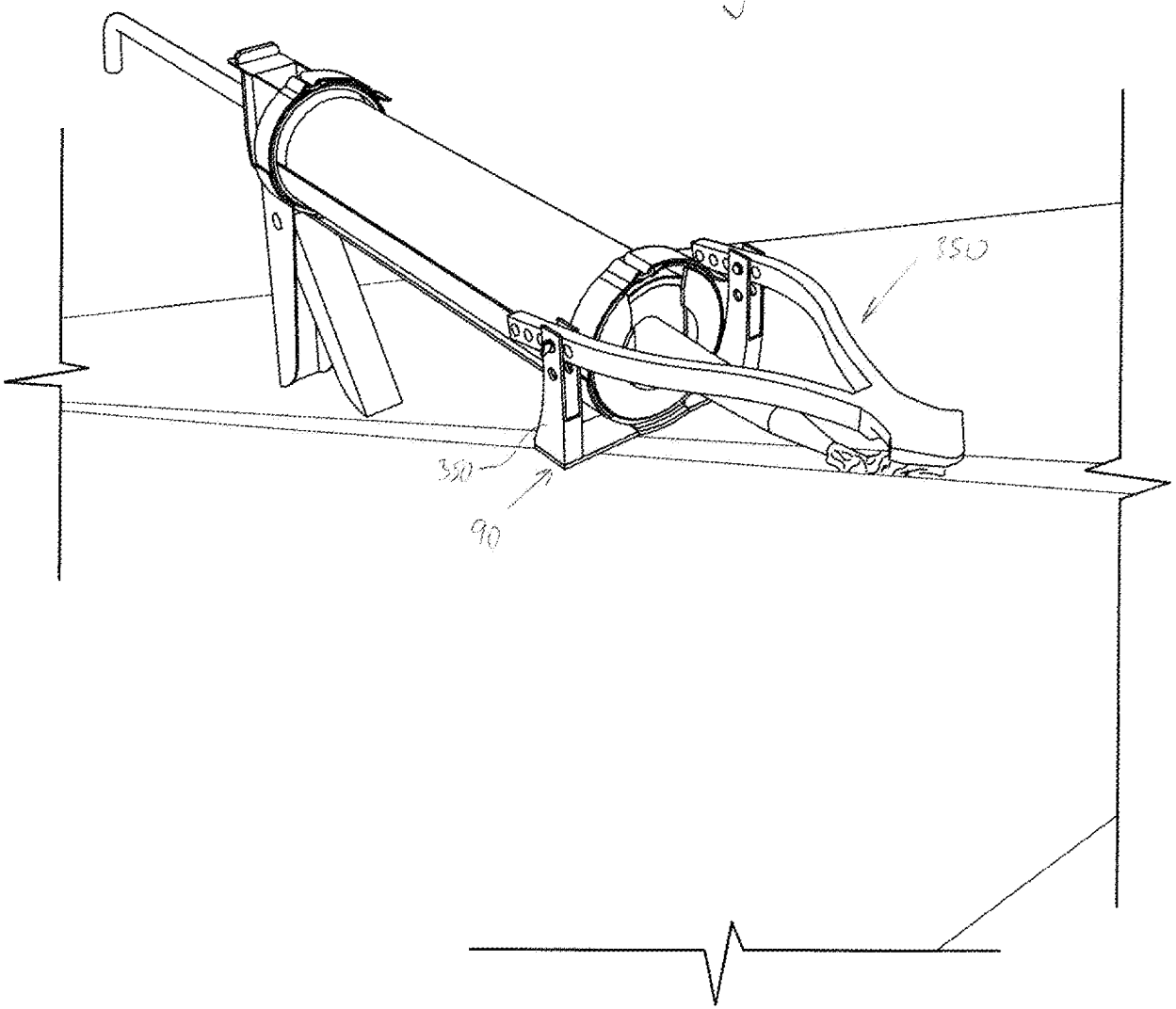
FIG. 20 is an alternative embodiment of the disclosed apparatus, shown without tape rollers.

FIGS. 19 and 20 demonstrate two alternative designs of the adapter 10. In FIG. 19, the adapter 10 is configured only with deploying tape strips 192 and 202 along the edge of the groove or groove or seam 206. FIG. 20 demonstrates just an attachment of the forward extending tool 350 extending from the two parallel uprights 330, extending from the angled bracket 90.

Figure 21:
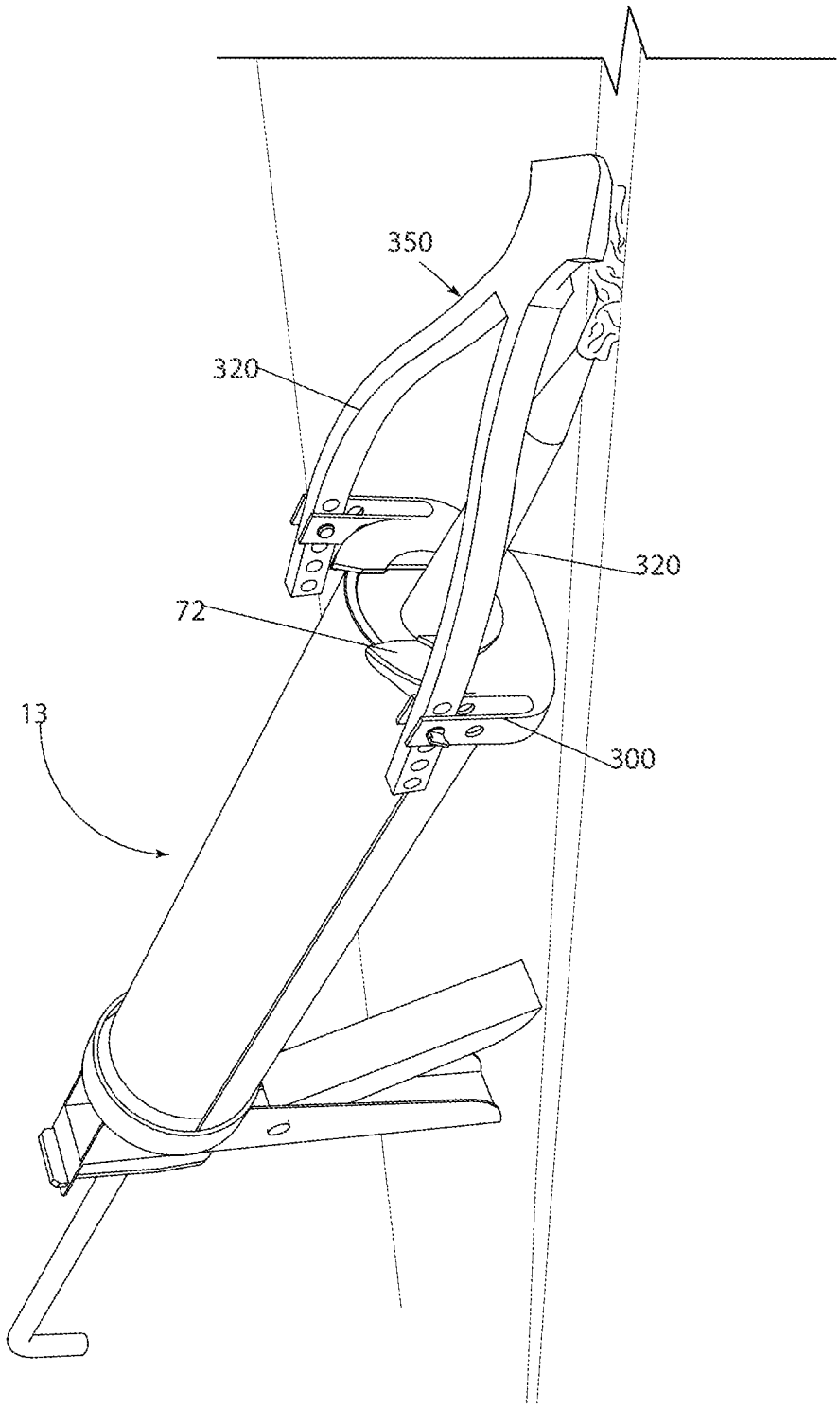
FIG. 21 is an alternative embodiment of the disclosed apparatus demonstrating the attachment of the scraping tool on the corpus of a caulking gun.

FIG. 21 demonstrates a caulking gun 13 having a forward extending tool 350 mounting directly to the front wall 72 using at least one upright support 300. Only one support arm 320 is required to support the tool 350, with the second support arm 320 coaxially mounted on a parallel upright support 300 for greater stability.

Figure 22:
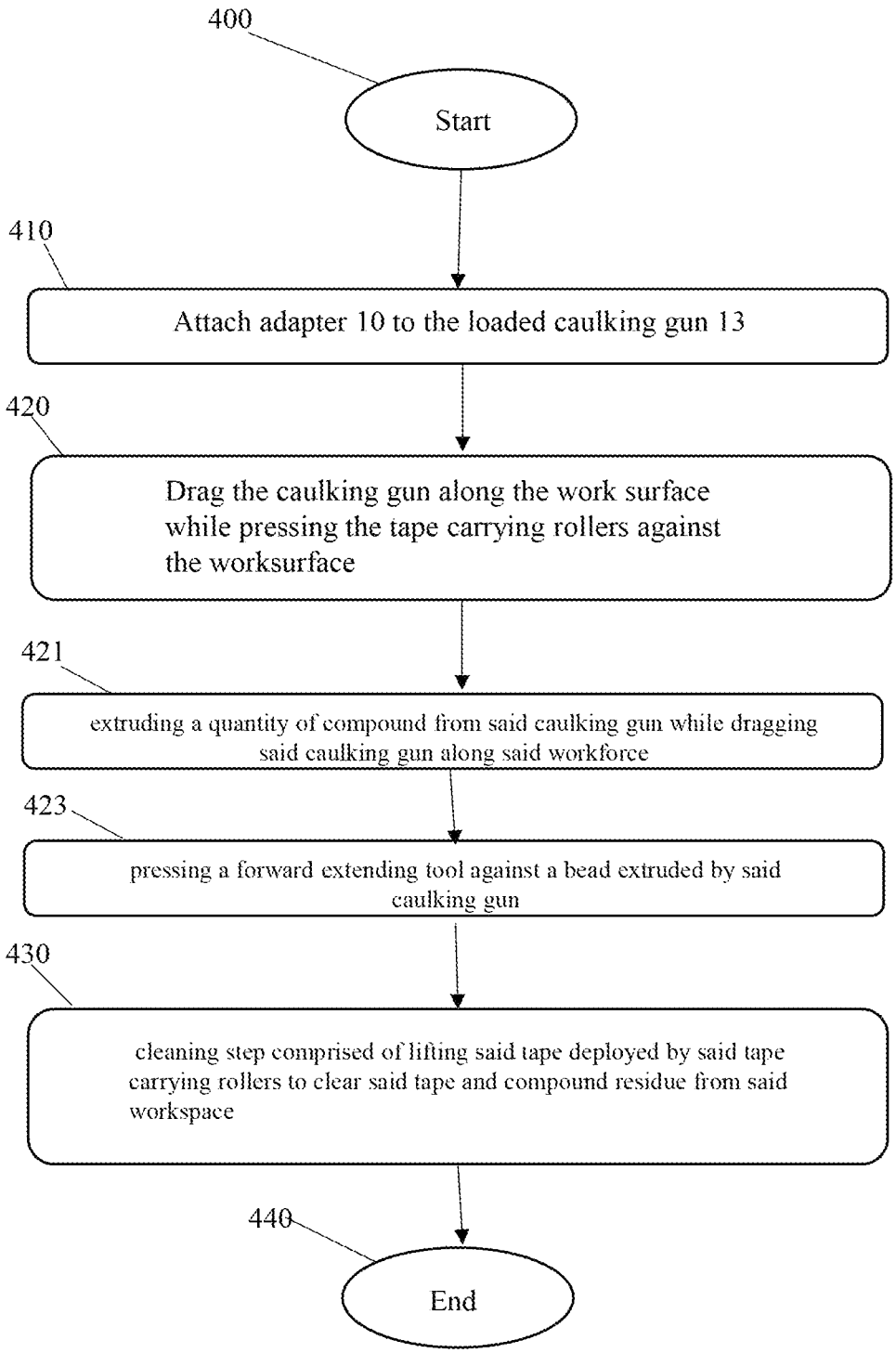
FIGS. 22 and 23 are drawn to the method that is unable using the disclosed apparatus.
Figure 23:
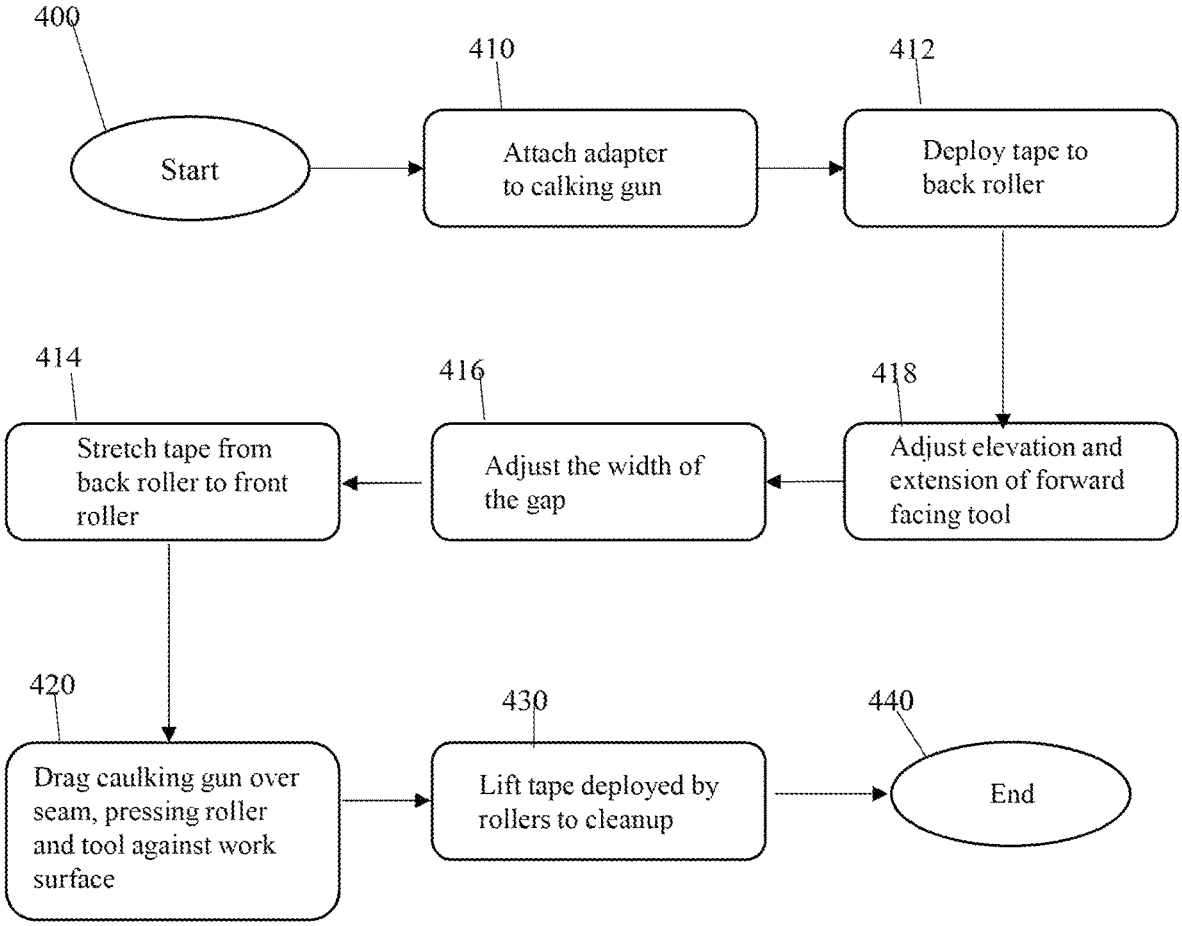

FIGS. 22 and 23 describe a method of caulking comprising the steps of attaching an adapter to a cannister supporting cradle of a caulking gun 410, followed by the dragging said caulking gun along a worksurface while pressing tape carrying rollers (this is a combination of the first or second rollers 140 and 142 and rear rollers 170 and 180) against said worksurface to protectively cover a section of said worksurface 420; extruding a quantity of compound from said caulking gun while dragging said caulking gun along said workforce 421; pressing a forward extending tool against a bead extruded by said caulking gun 423; and a cleaning step comprised of lifting said tape deployed by said tape carrying rollers to clear said tape and compound residue from said workspace 430. The method of deploying the tape over rollers may further comprising the steps of increasing or decreasing a gap between the tape carrying rollers to ensure that the tape is deployed directly adjacently to a workspace receiving a bead of said compound 416; and adjusting elevation of said forward extending tool with respect to said nozzle 418. The method of attaching said adapter to caulking gun 410 may further comprise the steps of deploying tapes onto a rear roller 412; and stretching a free portion of said tape to a front roller 414.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An adapter apparatus comprising; a base wall having a first end and a second end, said base wall having a first attachment means and a second attachment means; wherein said first attachment means secured to said base wall near said first end; and wherein said second attachment means secured at said second end;

wherein said first and said second attachment means configured to secure said base wall to a canister cradle of a caulking gun; an angle bracket; said angle bracket mounting at said first end below said first attachment means; said angle bracket having a first wall;

wherein said first wall being perpendicular to axis of said base wall; said first wall further comprising of a second wall downwardly extending from a free end of said first wall; wherein said second wall having first opening therethrough; a first pivot mounted within said opening; a first roller pivotedly mounting on said first pivot; a rear angle bracket, said rear angle bracket mounting along a length of said base wall; wherein said rear angle bracket having a rear pivot mounting therethrough at an angle perpendicular to the axis of said base wall and parallel with said first pivot; a first back roller pivotedly mounting on said rear pivot; wherein said first back roller mounting directly behind said first roller, such that said first back roller suitable or supporting a roll of tape mounting thereon; wherein said roll of tape capable of extending a section of tape toward said first roller; and wherein said section of tape disposing beneath said first roller.

2. The adapter of claim 1, wherein said second wall further comprising a second opening said second opening passing a supplemental pivot therethrough; wherein said supplemental pivot being in a parallel and spaced apart configuration with said first pivot; at least one supplemental roller mounting over said supplemental pivot; and wherein said least one supplemental roller configured to support said section of tape passing over said at least one supplemental roller and then beneath said first roller.

3. The adapter of claim 2, wherein said angle bracket further comprising a third wall, said third wall extending downwardly from said first wall in a parallel and spaced apart orientation with said second wall; said third wall having a first opening therethrough; said first opening being opposite of said first opening of said second wall;

wherein said first pivot passing through and terminating within said first opening of said third wall.

4. The adapter of claim 3, further comprising a two parallel upright supports, a base of said two parallel upright supports disposed on opposite free ends of said first wall extending upwardly thereform; wherein each of said two parallel upright supports having a forward facing opening; wherein said forward facing opening on each of said parallel upright support being co-axial with each other; wherein each of said forward facing opening configured to adjustingly secure one of arms of a forward extending tool; wherein said arms are configured to be linked together at said forward extending tool at a point ahead of a nozzle of a cannister placed in said cannister cradle.

5. The adapter of claim 3, further comprising a second roller rotatingly mounted on said first pivot in a spaced apart configuration with said first roller.

6. The adapter of claim 5, wherein said rear bracket further comprising a second back roller mounting on said rear pivot in a spaced apart configuration with said first back roller; wherein said second back roller oriented linearly behind said second roller; said second back roller suitable or supporting a roll of tape mounting thereon;

wherein said roll of tape capable of extending a section of tape toward said second roller;

and wherein said section of tape disposing beneath said second roller after passing over said at least one supplemental roller.

7. The adapter of claim 6, further comprising at least one third roller, said third roller rotatingly mounted on said first pivot between said first and said second rollers, wherein a diameter of said at least one third roller being greater than diameter of said first roller or said second roller.

8. The adapter of claim 7, wherein said at least one third roller may be comprised of additional or fewer rollers, said additional or fewer rollers used to reduce or increase space between said first roller and said second roller.

9. The adapter of claim 8, further comprising a two parallel upright supports, a base of said two parallel upright supports disposed on opposite free ends of said first wall extending upwardly thereform; wherein each of said two parallel upright supports having a forward facing opening; wherein said forward facing opening on each of said parallel upright support being co-axial with each other; and wherein each of said forward facing opening configured to secure one of arms of a forward extending tool;

wherein said arms are configured to be linked together at said forward extending tool at a point ahead of a nozzle of a cannister placed in said cannister cradle.

10. The adapter of claim 9, wherein said forward extending tool made from a group comprising a scraper, a roller, a spatula or brush; and where said forward extending tool connecting to each of said two parallel upright supports using said supporting arms.

* * * * *